US006988390B2

(12) United States Patent
Jeandeaud et al.

(10) Patent No.: US 6,988,390 B2
(45) Date of Patent: Jan. 24, 2006

(54) METHOD AND INSTALLATION FOR MAKING A WORKPIECE COMPRISING AT LEAST A TUBULAR SECTION

(75) Inventors: Jean-Claude Jeandeaud, Saint Marcel Bel Accueil (FR); Jean-Pierre Reyal, Eragny (FR)

(73) Assignee: Imphy Alloys, Puteaux (FR)

( * ) Notice: Subject to any disclaimer, the term of this patent is extended or adjusted under 35 U.S.C. 154(b) by 294 days.

(21) Appl. No.: 10/381,371

(22) PCT Filed: Sep. 25, 2001

(86) PCT No.: PCT/FR01/02970

§ 371 (c)(1),
(2), (4) Date: Mar. 25, 2003

(87) PCT Pub. No.: WO02/26412

PCT Pub. Date: Apr. 4, 2002

(65) Prior Publication Data

US 2003/0192356 A1 Oct. 16, 2003

(30) Foreign Application Priority Data

Sep. 26, 2000 (FR) ..... 00 12240

(51) Int. Cl.
*B21D 5/00* (2006.01)

(52) U.S. Cl. ..... 72/379.2; 72/51; 72/380

(58) Field of Classification Search ..... 72/51, 72/310, 379.2, 380, 381, 382, 383
See application file for complete search history.

(56) References Cited

U.S. PATENT DOCUMENTS

| | | | | |
|---|---|---|---|---|
| 422,744 | A * | 3/1890 | Dixon | 72/310 |
| 562,877 | A * | 6/1896 | Wittebolle | 72/310 |
| 1,708,615 | A * | 4/1929 | Groehn et al. | 228/173.6 |
| 3,577,755 | A * | 5/1971 | Fricker | 72/51 |
| 3,740,992 | A * | 6/1973 | Kienzler et al. | 72/361 |
| 4,365,500 | A | 12/1982 | Klukow | |
| 5,007,264 | A | 4/1991 | Haack | |
| 6,412,325 | B1 * | 7/2002 | Croswell | 72/324 |

FOREIGN PATENT DOCUMENTS

| | | |
|---|---|---|
| DE | 1927520 | 1/1971 |
| EP | 1032016 | 8/2000 |
| FR | 2790140 | 8/2000 |

* cited by examiner

*Primary Examiner*—Lowell A. Larson
(74) *Attorney, Agent, or Firm*—Dowell & Dowell, P.C.

(57) ABSTRACT

A method of forming a tubular workpiece which consists in pre-bending a metal plate along at least two longitudinal lines of bend (12–13) then in bending the plate along at least one of the lines of bend (12–13) using a bending member (103–104) that exerts an external clamping force ($F_7$, $F_8$) along a part (23, 24) of the plate towards the at least one of the lines of bend (12, 13). Thereby preventing any sliding of part (23, 24) of the plate along the bending member (103–104) as the bending member bends the part. The bending member is articulated about a virtual geometrical axis (a, c) located inside a tubular section of the workpiece.

33 Claims, 17 Drawing Sheets

METHOD AND INSTALLATION FOR MAKING A WORKPIECE COMPRISING AT LEAST A TUBULAR SECTION

BACKGROUND OF THE INVENTION

1. Field of the Invention

The invention relates to a method and to an installation for making a workpiece comprising at least one tubular part obtained by bending a metal sheet. This method and this installation are particularly adapted to the manufacture of a shadow mask support frame for a cathode-ray display tube.

2. Brief Description of the Related Art

Such a frame is used for example in the domain of the manufacture of colour televisions. The colour display cathode-ray tubes comprise a metal foil pierced with a plurality of holes or slots, called "shadow mask" and disposed between the electron gun and the display screen. Such a shadow mask is supported by a frame, generally rectangular in shape, which holds it in position in the vicinity of the display screen and, if necessary, ensures that the mask is taut in order to limit the deformations resulting from the local overheatings created by the electron beams.

It is known from EP-A-0 809 272 to produce a shadow mask frame from two thin metal strips joined to each other and comprising ribs for rigidification. Such a frame is light and rigid, which allows it to be used for a taut shadow mask and for a crimped shadow mask. Application FR-A-2 790 140 discloses a shadow mask frame comprising tubular parts formed by bending a metal sheet. The sheet may be bent by different methods, in particilar by hand, but a manual bending is not compatible with high-rate industrial production. Furthermore, the known methods of bending with the aid of machines comprising an apron, sometimes called "support strap", on which a metal sheet to be bent is held with the aid of a holding clamp, and an articulated bending flap, do not allow tubular parts to be easily manufactured.

SUMMARY OF THE INVENTION

It is an object of the present invention to propose a method of bending with the aid of a bending machine making it possible to manufacture workpieces comprising at least one tubular part, particularly a workpiece constituting one or more uprights of a frame supporting a shadow mask.

In this spirit, the invention relates to a method for making a workpiece comprising at least one tubular section obtained by bending a metal plate along at least one longitudinal edge, characterized in that it comprises steps consisting in pre-bending the plate along at least two bending edges or lines of bending then in exerting, during bending, a clamping force along at least one part of the plate by a bending member.

With the invention, the metal plate is efficiently displaced by the bending member, without risk of sliding that may result in an imprecise bending along the edge or line of bending. Because of the pre-bending, the plate is maintained in position on an apron or supporting beam on which it rests, without risk of buckling during subsequent bending. The force of clamping or of holding of the plate with respect to the line of bending makes it possible to hold the plate in position with respect to its environment without resorting to fixing clips which could be used inside tubular parts only with difficulty, as they would hinder the bending operations.

According to advantageous but non-obligatory aspects of the invention, the method incorporates one or more of the following characteristics.

The pre-bending is effected by immobilizing the plate on an apron by means of a retractable holding clamp. In addition, a step of preparation of the pre-bending may be provided, by weakening the metal sheet along the lines of bending. Such weakening may be effected by marking or punching through a part of the thickness of the metal sheet, or by any other suitable method.

The plate is bent along different edges or lines of bending over the length of the workpiece to be manufactured, with the result that tubular sections of different basic profiles are formed. This makes it possible to produce workpieces of elaborate geometry, such as shadow mask support frames.

The plate is bent about at least one virtual geometrical axis defined by the cooperation of the bending member and of guiding means associated therewith.

The clamping force is essentially exerted on the outside of a tubular section of the workpiece, in the absence of a tightening effort or force exerted by a holding clamp or like equipment. This takes into account the fact that the use of a holding clamp is delicate with a tubular workpiece, and even impossible if it has sections of different basic profiles.

The clamping force is directed substantially in the direction of the bending edge or line of bending.

The clamping force is substantially perpendicular to the bending edge.

The clamping force stresses a part of the metal plate parallel to itself and perpendicularly to the bending effort exerted on this part by the bending member.

The clamping force is adapted as a function of the position of the bending member. This aspect of the invention makes it possible to take into account the dimensional variations of the plate in the course of the bending operation, such variations resulting in particular from the localized stresses at the edge, or line of bending, and of its radius of curvature. It also makes it possible to avoid an interference between the elements exerting a clamping force at two opposite edges, or lines of bending, of the plate.

The method further comprises a step consisting in causing a first part of the plate to overlap a second part thereof and in reducing the clamping force exerted on the second part before these parts are welded together. This aspect of the invention ensures that the overlapping parts are in elastic contact during welding, which allows this welding to be efficient and lasting.

The method also comprises a step consisting in bending the plate about at least one virtual axis defined as the geometrical axis of a cylindrical cradle for guiding the bending member. The use of a virtual axis makes it possible to move the bending member without resorting to a hinge capable of interfering with other parts of the installation and dedicated to a bending along another edge or line bending. In particular, it may be provided to bend the plate about different bending axes depending on the length of the workpiece, using bending members guided by cradles of different geometrical axes corresponding to these bending axes.

The method comprises a step consisting, after formation of a plurality of tubular sections, in shaping them into a closed frame by bending joining sections, between two adjacent tubular sections, perpendicularly to the principal directions of these tubular sections.

The method comprises a step consisting in applying, by suction or magnetic attraction, a part of the sheet metal plate against a part of the bending member.

The invention also relates to an installation for carrying out the method described hereinabove and, more specifically, to an installation comprising at least one member for bending a metal plate along a longitudinal edge or bend line of a tubular section of the frame, characterized in that the bending member is equipped with means for exerting on a part of the plate a clamping force countering a sliding of a part of the plate along the bending member, while the bending member is articulated about a virtual geometrical axis located inside the corresponding tubular section.

According to advantageous but non-obligatory aspects of the invention, the installation incorporates one or more of the following characteristics.

A plurality of bending members are adapted to bend the plate along distinct lines or edges, with the result that tubular sections of different basic profiles are formed.

The clamping means are constituted by at least one heel forming a stop for abutment of the plate. This heel may extend over substantially the whole length of the line or edge. It is also possible to provide a plurality of heels distributed over the length of the bending line or edge and separated by spaces for receiving holding heels used for bending the plate along another line or edge.

The clamping means have a variable position with respect to the bending line or edge. This may come from the fact that the installation comprises means for adjusting or adapting the effort exerted by the clamping means on the plate.

The bending member comprises at least one surface for bearing against the plate and at least one circular-base cylindrical surface adapted to cooperate with a circular-base cylindrical surface of a cradle, these cylindrical surfaces being centered on a virtual axis of bend of the plate. The use of such a cradle makes it possible to guide the bending member without resorting to a hinge that could interfere with adjacent devices. In that case, the installation may be provided to comprise a plurality of bending members distributed over the length of the plate and cooperating with cradles of which the cylindrical surfaces have parallel geometrical axes offset with respect to each other. This makes it possible to bend the plate along distinct longitudinal lines or edges, over its length, which enables tubular sections of different geometries to be shaped, corresponding for example to distinct sides of a frame to be made. The bending member or members are advantageously equipped with an outer rib forming a cylindrical surface adapted to cooperate with the cylindrical surface of the corresponding cradle, these cylindrical surfaces being substantially of the same radii. According to an advantageous embodiment of the invention allowing tippings of great amplitude, the bending member or members are guided with respect to the cylindrical surface of the cradle by telescopic segments which slide in one another. The surfaces of the ribs, the telescopic segments and/or the surfaces of the cradles may be equipped with sliding balls or rollers.

The installation comprises a tool for shaping the workpiece, the tool including elements for supporting tubular sections of the workpiece provided with means for receiving and immobilizing these tubular parts, these elements being articulated with respect to one another. This tool allows the final shaping of the frame after the tubular parts have been produced. At least one of the articulated elements may be provided to be adjustable in length, which makes it possible to adapt the tool to the manufacture of frames of different dimensions. The articulated elements may also be provided to be adapted to form with one another a closed figure of predetermined geometry, corresponding to the geometry of a frame formed by the manufactured workpiece. The closed nature of the figure obtained makes it possible to obtain an increased geometrical precision thanks to a universal positioning of the different elements constituting the tool. According to an advantageous form of embodiment of the invention, at least one of the articulated elements is equipped with a member, of cross-section substantially in the form of a U and adapted to receive at least one shim for blocking a tubular section in place in the member, means being provided to immobilize the shim on this member.

At least one of the bending members is equipped with a blade forming shears for cutting out the plate during bending thereof.

Finally, the invention relates to the use of the method or of the installation mentioned hereinabove for manufacturing a shadow mask support frame for a cathode-ray tube.

At least one of the bending members is equipped with a blade forming shears for cutting out the plate during bending thereof.

Finally, the invention relates to the use of the method or of the installation mentioned hereinabove for manufacturing a shadow mask support frame for cathode-ray tube.

BRIEF DESCRIPTION OF THE DRAWINGS

The invention will be more readily understood and other advantages thereof will appear more clearly in the light of the following description of two forms of embodiment of an installation for manufacturing a shadow mask support frame and of its method of implementation, given solely by way of example and made with reference to the accompanying drawings, in which.

DESCRIPTION OF THE PREFERRED EMBODIMENTS

Figure 1:
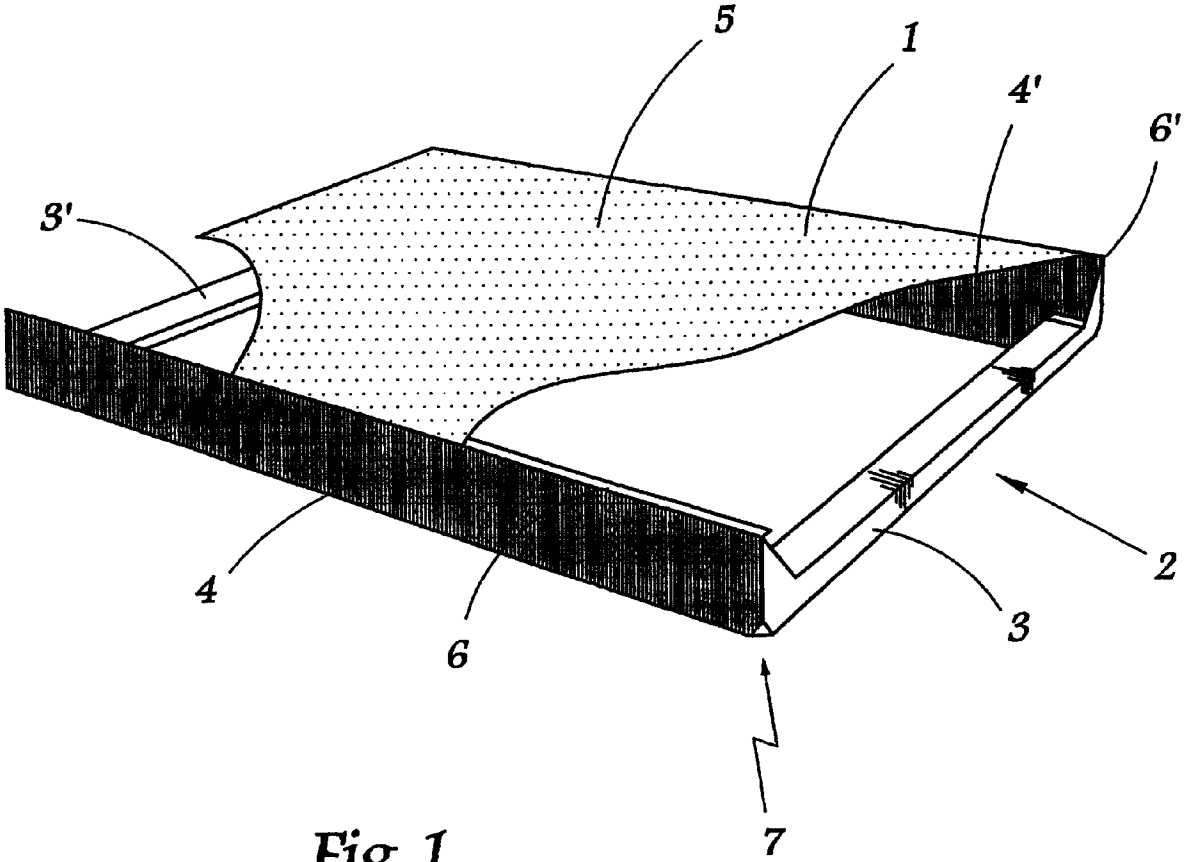
FIG. 1 schematically shows a shadow mask frame on which is disposed a partially shown shadow mask.
Figure 2:
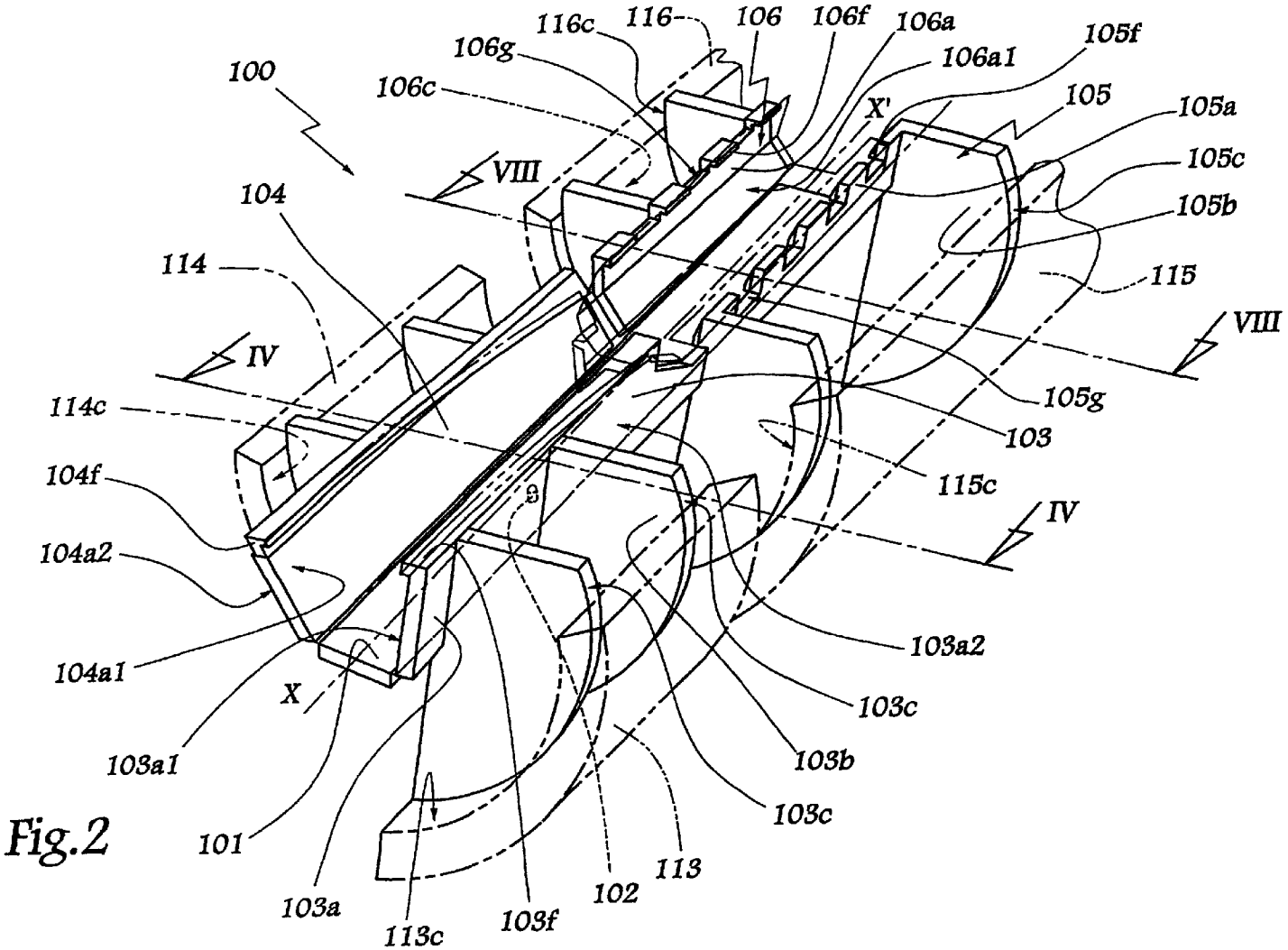
FIG. 2 schematically shows a perspective view of a part of an installation for manufacturing the frame of FIG. 1, the frame not having been shown.

FIG. 1 schematically shows a shadow mask 1 mounted on a shadow mask supporting frame 2. The frame is generally rectangular in shape and comprises two lateral uprights 3, 3' and two end uprights 4, 4'. The shadow mask is constituted by a thin metal foil, for example of iron-nickel alloy with a low coefficient of expansion, pierced with holes 5 and fixed by welding on upper edges 6, 6' of the end uprights 4, 4'. Different forms of shadow mask are possible as a function of the cathode-ray tube with which it is to be associated. In the example shown, the shadow mask is substantially planar, but it may equally well be curved into a portion of cylinder. The mask I may in addition be taut, i.e. subjected to a tension parallel to the lateral uprights 3, 3' of the frame 2.

The uprights 3, 3', 4 and 4' are formed by bending a sheet metal so as each to constitute a tubular element. These four uprights may be obtained by bending a single metal plate. It is also possible to provide using one bent plate for each upright or one plate for two contiguous uprights.

In the example illustrated in the Figures, a single metal plate 10 is used for making the four tubular uprights 3, 3', 4, 4'. This plate is partially visible in FIG. 3 after steps of cutting out assembly tongues 11 and of pre-marking longitudinal edges 12 to 17.

At the level of the edges 12 to 14, the plate 10 forms the end upright 4. At the level of edges 12 and 15 to 17, the plate 10 forms the lateral upright 3. In practice, the part of the plate 10 shown in FIG. 3 corresponds to the corner 7 of the frame 2 at the level of which the join is made between the uprights 3 and 4.

Figure 3:
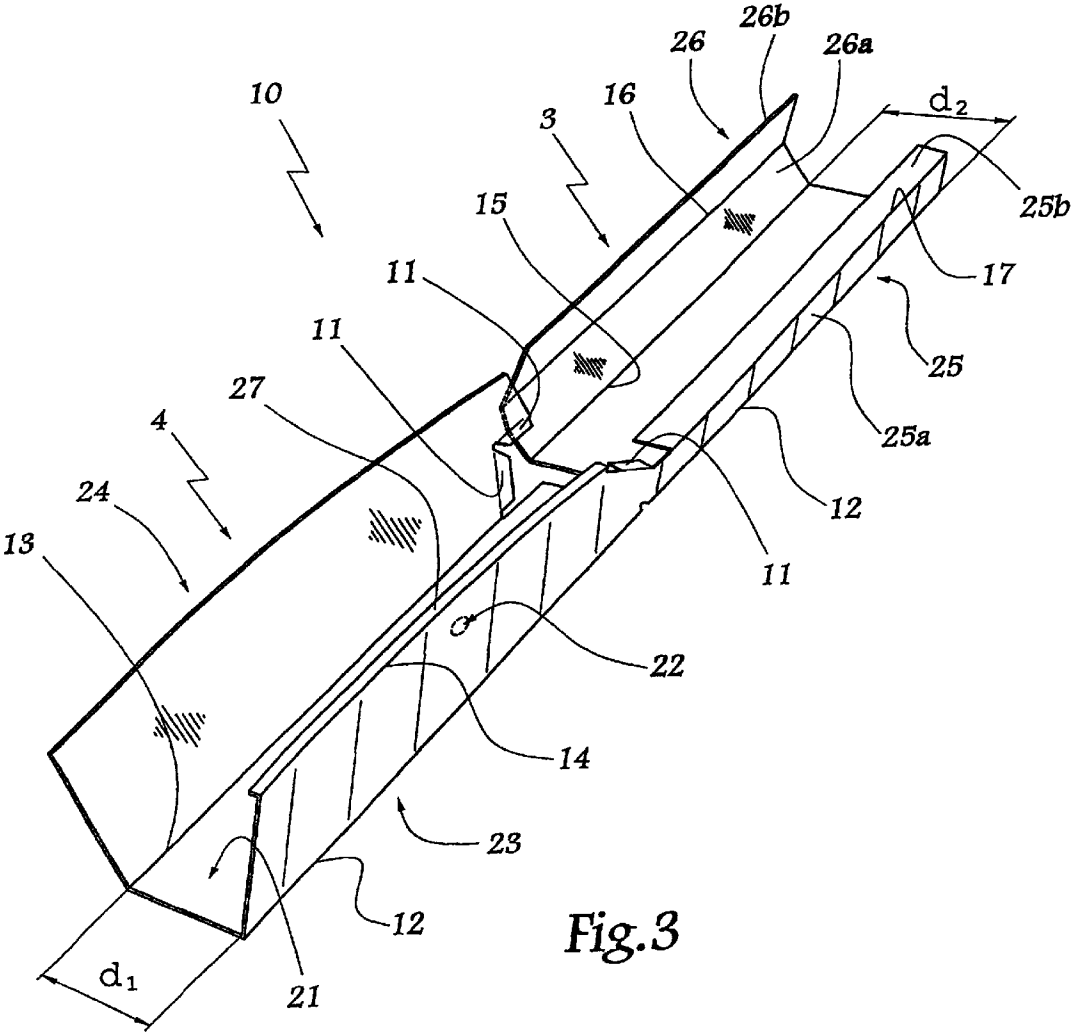
FIG. 3 schematically shows a part of the frame of FIG. 1 when it is in place in the installation of FIG. 2.

The plate 10 is shaped in the configuration of FIG. 3 by operations of cut out, stamping and bending using, in particular, punches intended to create in the plate 10 an edge 12 extending over substantially the whole of its length while the edges 13 to 17 extend over only a part of the plate 10, the edges 13 and 15 being parallel to each other but offset, i.e. distant from the edge 12 by different distances $d_1$ and $d_2$.

Figure 5:
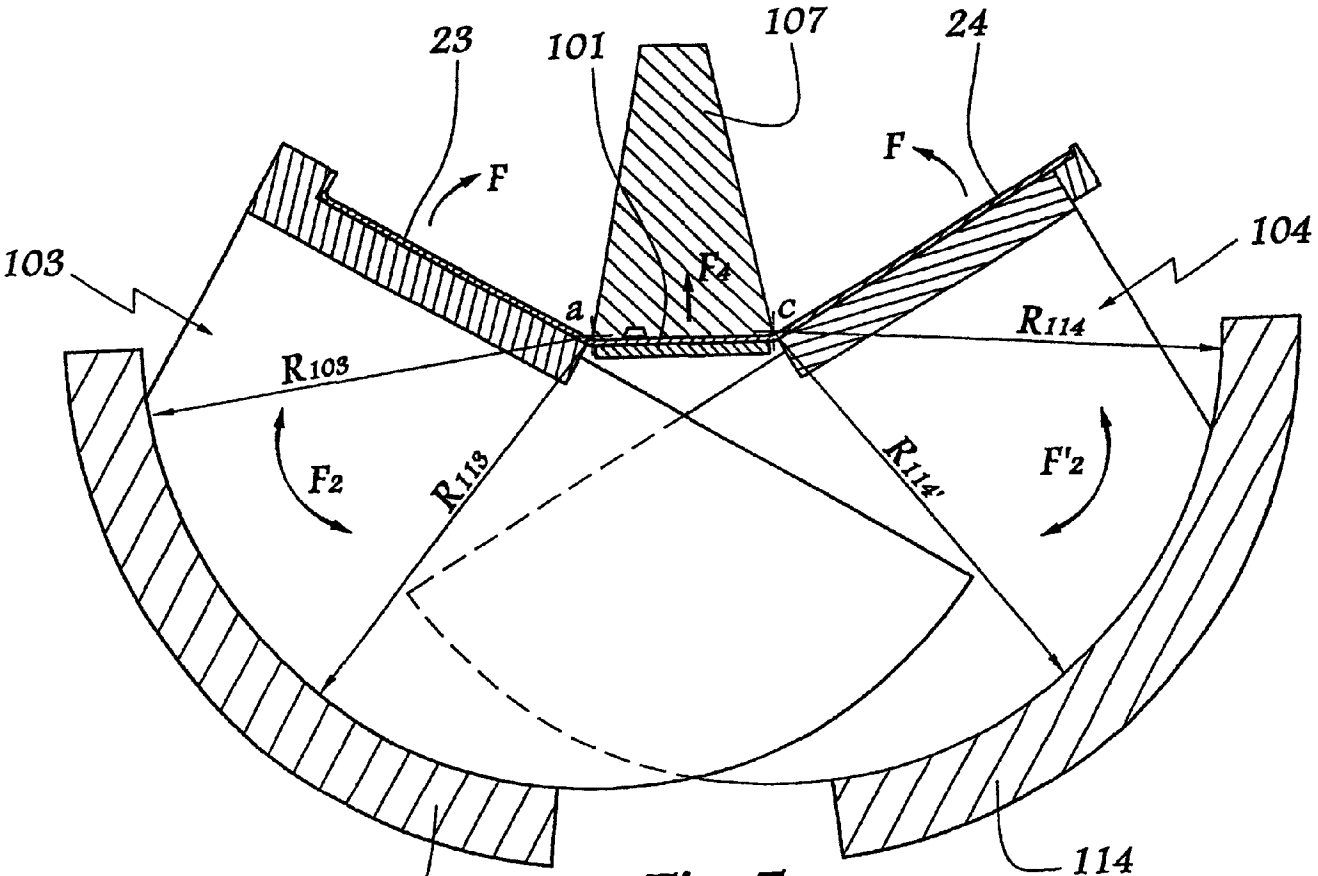
FIG. 5 is a section similar to FIG. 4 during a first step of the method of the invention, prior to the configuration of FIG. 4.

As is more particularly visible in FIG. 5, the pre-bending of the plate 10 is effected by immobilizing this plate on an apron or support strap 101 thanks to a holding clamp 107 and by bending the plate 10 as represented by arrows F, which has the effect of creating the lines of bend 12 and 13. Another holding clamp is used at the level of the upright 3, which makes it possible to continue the creation of the line of bend 12 and to create the line of bend 15. This second holding clamp is also configured in order to allow the creation of the lines of bend 16 and 17.

Figure 4:
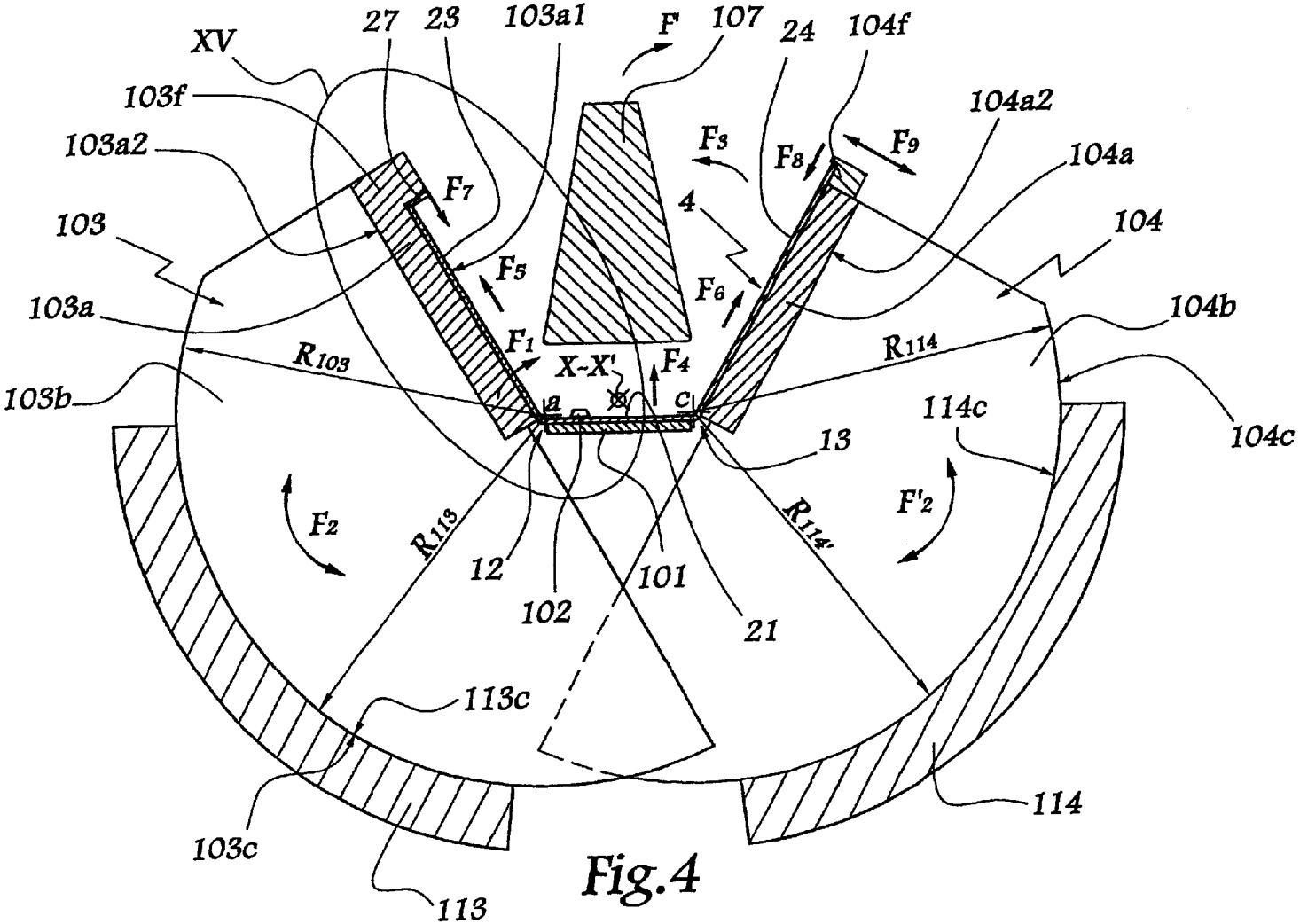
FIG. 4 is a section along line IV—IV in FIG. 2, the frame being shown in place in the installation.

These operations of pre-bending make it possible to attain the configuration of FIG. 4 in which the holding clamp 107 is retracted or withdrawn from the interior space of the plate 10 as represented by arrow F'. It will be noted that the shape of the holding clamp 107 is compatible with its withdrawal from the interior of the plate 10 in the configuration of FIG. 4.

Thanks to this operation of pre-bending, the plate 10 is immobilized with respect to the installation of the invention, as it is in abutment along the two bending edges 12 and 13 or 12 and 15 which are substantially parallel.

Pre-bending may be prepared by a marking of the lines of bend, for example by a stamping through a part of the thickness of the plate 10, in particular of 25%.

In general, the pre-bending of the plate 10 may be effected on the machine shown in the Figures or on another machine, without departing from the scope of the present invention.

In the event of an upright being made whose section has more than three sides, such as upright 3, preliminary pre-bendings are necessary in order to make the edges of the type of edges 16 and 17. Such a preliminary pre-bending is also used in the case of the upright 4 for making the edge 14.

The installation 100 of the invention comprises the apron 101 on which is placed a central part 21 of the plate 10. Studs, of which only one is visible in the Figures with reference 102, extend from this plate 101 and are intended to traverse openings 22 provided in the part 21, so as to position the plate 10 on the base plate 101.

From the part 21 there extend two flanges 23 and 24 of the plate 10 intended to form the upright 4. From this same same central part 21 there extend two other flanges 25 and 26 intended to form the upright 3.

The flanges 23 and 25 are connected to the part 21 along the edge 12. The flanges 24 and 26 are respectively connected to the part 21 along the edges 13 and 15. The flange 23 is connected to a border 27 by the line of bend or edge 14 while the flanges 25 and 26 are both divided into two panels 25*a*, 25*b* and 26*a*, 26*b* respectively, by the lines of bend or edges 16 and 17.

The installation 100 comprises a bending jaw 103 intended to bend the flange 23 down in the direction of part 21 thanks to an effort represented by arrow $F_1$. The jaw 103 comprises plate 103*a* whose length, parallel to a longitudinal axis X–X' of the installation 100, is adapted to the length of the flange 23. The face 103*a*1 of the plate 103*a* intended to be in contact with the flange 23 is substantially planar. The plate 103*a* is equipped, on its face 103*a*2 opposite the face 103*a*1, with two ribs 103*b* extending opposite the flange 23 in directions substantially perpendicular to axis X–X'. These ribs 103*b* each form a convex surface 103*c* in the form of a portion of cylinder with circular base centred on a virtual axis a. "Virtual" is understood to mean the fact that the axis a is not defined by a hinge, but as being the geometric focus joining the centres of curvature of the surfaces 103*c*. This axis is located inside the upright 4 and is parallel to axis X–X'.

The installation 100 also comprises a cradle 113 defining a cylindrical inner surface 113*c* and with circular base against which the ribs 103*b* are in sliding abutment by their surfaces 103*c*. The axis of symmetry of the surface 113*a* is also the axis a. The radii of curvature $R_{103}$ and $R_{113}$ of the surfaces 103*c* and 113*c* are equal. It is thus possible to pivot the jaw 103 in the cradle 113 about the axis a, as represented by arrow $F_2$ in FIG. 4, by relative slide of the surfaces 103*c* and 113*c*.

A second jaw 104 comprises a plate 104*a* intended to come into abutment, by a face 104*a*1, against the flange 24 and to exert thereon an effort $F_3$ making it possible to bend it down in the direction of the base plate 101 and of the central part 21. The plate 104*a* is provided, on its face 104*a*2 opposite the face 104*a*1, with ribs 104*b* of which an outer or convex surface 104*c* is cylindrical with circular base and adapted to come into abutment against an inner or concave cylindrical surface with circular base 114*c* of a cradle 114. c denotes the common central geometrical axis of the surfaces 104*c*, this axis being parallel to axis X–X' and located in the interior volume of the upright 4. 114*c* and $R_{104}$ and $R_{114}$ denote the respective radii of the surfaces 104*c* and 114*c*, these radii being of the same length. The jaw 104 may pivot about the axis c being guided by the cradle 114, as represented by arrow $F'_2$.

Figure 6:
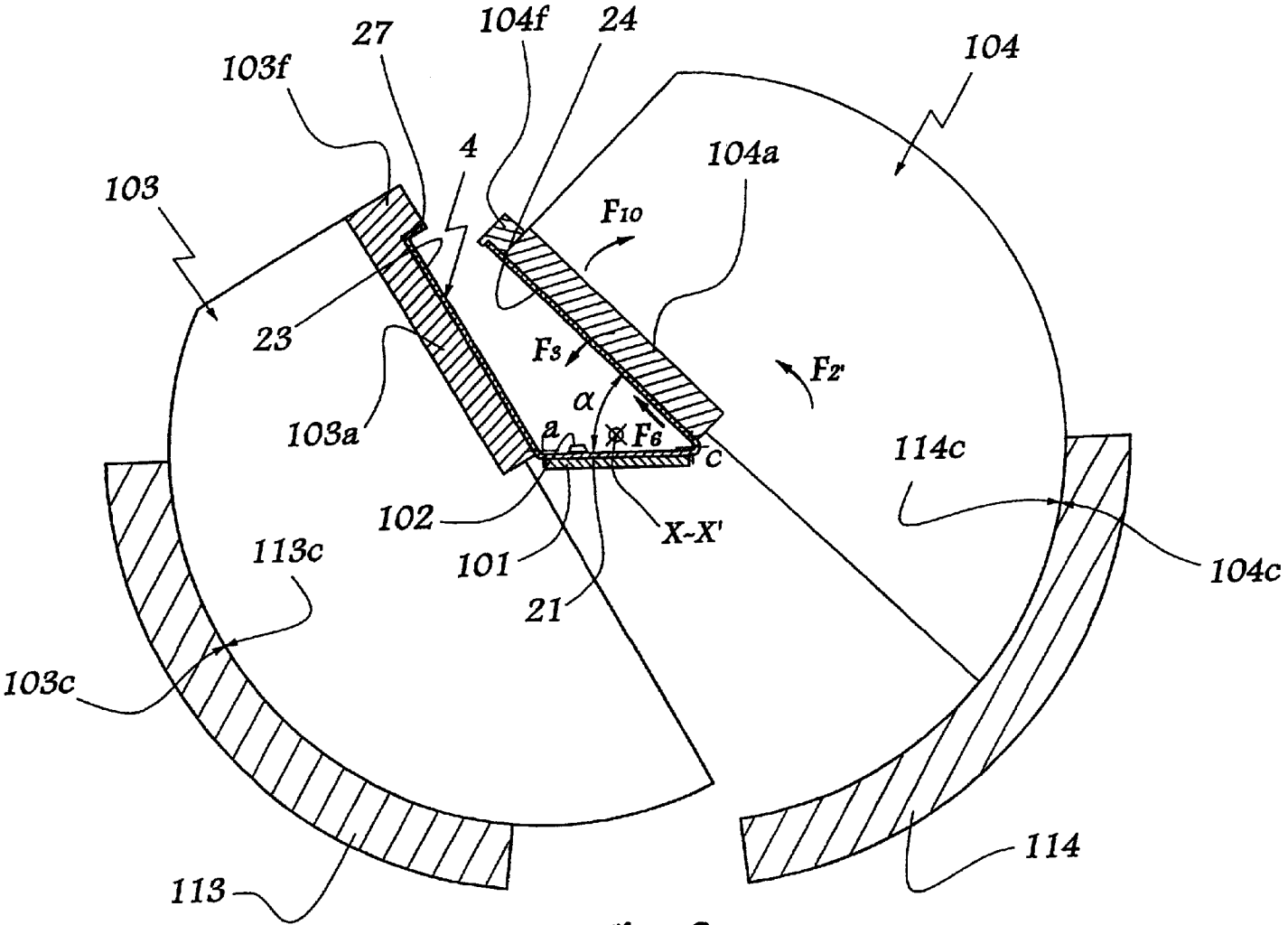
FIG. 6 is a section similar to FIG. 4 during a subsequent step of the method of the invention, later than the configuration of FIG. 4.
Figure 7:
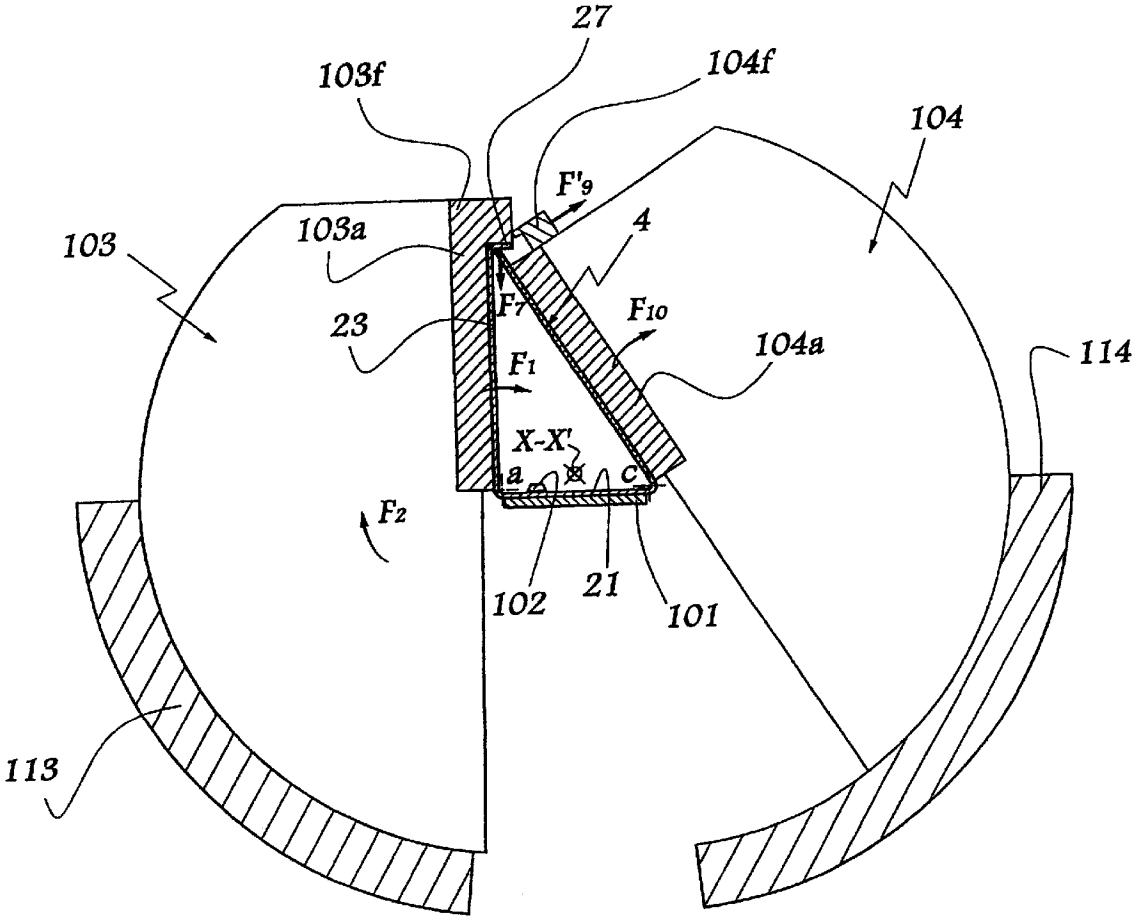
FIG. 7 is a section similar to FIG. 4 during a second subsequent step of the method of the invention

Referring more particularly to FIGS. 4, 6 and 7, it will be understood that it is possible to shape the plate 10 in a tubular section with substantially triangular base thanks to efforts $F_1$ and $F_3$.

However, from the position of FIG. 4, if the efforts $F_1$ and $F_3$ are exerted while the flanges 23 and 24 rest respectively against the plates 103*a* and 104*a* without any other effort, the plate 10 risks rising in the direction of arrow $F_4$ in FIG. 4, because the flanges 23 and 24 risk sliding along the surfaces 103*a*1 and 104*a*1, as respectively represented by arrows $F_5$ and $F_6$. This might result in an imprecise bending at the level of the edges 12 and 13 of which the centre of curvature would in that case no longer merge with the geometrical axes a and c.

In order to avoid relative movements between the flanges 23 and 24 and the surfaces 103*a* and 104*a*, the jaws 103 and 104 are each equipped with a heel 103*f*, 104*f* adapted to exert on the flanges 23 and 24 an effort, respectively denoted $F_7$ and $F_8$, directed substantially towards the edges 12 and 13, i.e. countering a slide of the flanges 23 and 24 in the direction of arrows $F_5$ and $F_6$. The efforts $F_7$ and $F_8$ therefore constitute efforts of clamping or of holding of the flanges 23 and 24 with respect to the jaws 103 and 104. In particular, the flanges 23 and 24 do not risk projecting radially outside the jaws 103 and 104.

In other words, the heels 103*f* and 104*f* form stops to the displacement of the flanges 23 and 24 in the direction of arrows $F_5$ and $F_6$.

It will be noted that the efforts $F_7$ and $F_8$ are exerted by the outside of the upright 4. In this way, the plate 10 is maintained on the apron 101 without using an added element, such as a holding clamp, this being favourable as a holding clamp would be delicate to place in position and to remove once the plate is bent. In addition, a holding clamp could not be extended up to the level of the upright 3.

The invention therefore allows a bending of the plate 10 into a tubular structure without introduction of a wedging device inside its different sections.

The heel 103*f* is in one piece with the plate 103*a*, this heel being intended to cover the border 27 of the flange 23. This heel 103*f* extends over the whole length of the jaw 103 parallel to axis X–X', which guarantees that the upper edge of the upright 4, on which the mask 5 is intended to be stretched, is bereft of irregularities. To that end, the heel 103 presents a regular surface towards the border 27 as the heel 103*f* serves for forming this border which must be as regular as possible for the mask 1, which is stretched on the upper edge of the upright 4, not to present a wave or element in relief capable of disturbing the image generated in the cathode-ray tube.

The 104*f*, which extends over the length of the jaw 104, is capable of moving perpendicularly to the plate 104*a* and to the flange 24, as represented by arrow $F_9$ in FIG. 4.

Functioning is as follows:

When the plate 10 has been positioned on the apron 101 and pre-bent thanks to the holding clamp 107, the jaw 104 is displaced by a pneumatic, electric or hydraulic jack, with the result that, thanks to the effort $F_3$ exerted by the plate 104*a*, it bends the plate 24 down in the direction of the part 21. The heel 104*f* exerts on the flange 24 an effort $F_8$ directed towards the edge 12, which guarantees a correct positioning of the flange 24 with respect to the jaw 104. The position of FIG. 6 is then attained, where the angle $\alpha$ between the flange 24 and the part 21 is less than 90°. From this position, the jaw 103 is actuated so that it bends the flange 23 down in the direction of the part 21 by exerting the effort $F_1$, as shown in FIG. 7. The jaws 103 and 104 are guided in their displacements $F_2$, and $F'_2$ thanks to the cooperation of the convex cylindrical surfaces 103*c*, 104*c* and concave ones 113*c*, 114*c*.

In order to avoid an interference between the heels 103*f* and 104*f*, the heel 104*f* is moved away from the flange 24, as represented by arrow $F'_9$ in FIG. 7. In effect, it is possible to eliminate the effort $F_8$ in the configuration of FIG. 6 as no displacement of the flange 24 is necessary between the configurations of FIGS. 6 and 7. Moreover, the fact that the angle $\alpha$ is less than 90° ensures an efficient positioning of the flange 24, including in the event of elimination of the effort $F_8$.

In other words, in the configurations of FIGS. 6 and 7, the effort $F_8$ is not indispensable as the plate 104*a* efficiently holds the flange 24 in position with respect to axis c.

According to a variant embodiment of the invention, it is possible to provide for a plurality of heels 104*f* to be distributed over the length of the plate 104*a*, parallel to axes X–X' and c.

Figure 15:
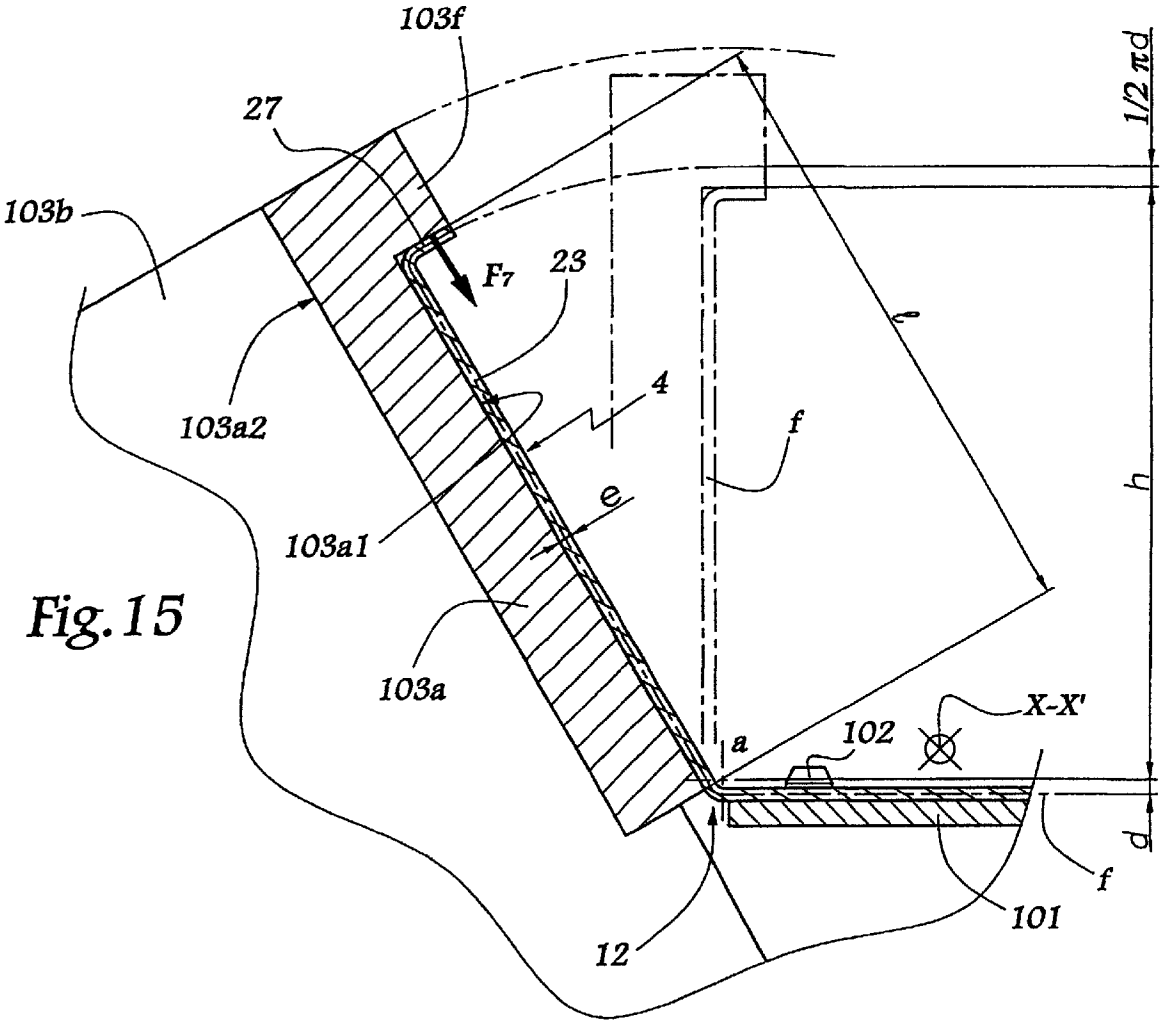
FIG. 15 is a partial schematic representation in section of a part of a plate in the course of bending.

Reference will now be made to FIG. 15 which is an enlargement of the detail XV in FIG. 4. The plate 10 has a non-zero thickness e. The passage from the position shown in solid lines to the position shown in dashed and dotted lines, which corresponds substantially to that of FIG. 7, has the effect of reducing the height h of the flange 23 in the configuration in dashed and dotted lines with respect to the length l of this flange in the solid line configuration as the neutral axis f of the plate 10 forms an arc of circle centred on the axis a in the configuration shown in dashed and dotted lines. If it is considered that axis a is located inside the zone intended to form the edge 12 with a distance d with respect to the neutral axis f and taking the example of a plate curved from a planar configuration to arrive at a configuration bent at 90°, the difference between the height h and the length l is $\frac{1}{2}\pi d$. In the present case, it is less insofar as the edge 12 is already pre-marked in the configuration of FIG. 4. However, it is not zero.

Taking into account this difference in values between the height h and the length l, the value of the effort $F_7$ should be adapted so that it efficiently immobilizes the plate 10 in the zone of the edge 12 all along the movement of rotation of the jaw 103 about axis a. To that end, the heel 103*f* is provided to be elastically loaded in the direction of axis a or of the edge 12. In that case, the heel 103*f* is not in one piece with the plate 103*a*. According to another approach, a cam system may be provided to allow the intensity of the effort $F_7$ to be varied as a function of the angular orientation of the jaw 103 about the axis a, in the course of the pivoting $F_2$.

According to another approach, it is possible to compensate this difference in value between the height h and the length l by offsetting the pivot axis a in a direction perpendicular to the principal plane of the apron 101. In that case, the heel 103*f* may be in one piece with the plate 103*a* of the jaw 103.

Of course, the heel 104*f* may also be provided with means for varying the intensity of the effort $F_8$ as a function of the position of jaw 104 about axis c in the course of pivoting $F'_2$. In a variant, the position of the axis c may also be provided to be variable in order to compensate the variations in length and/or height of the flange 24.

Figure 8:
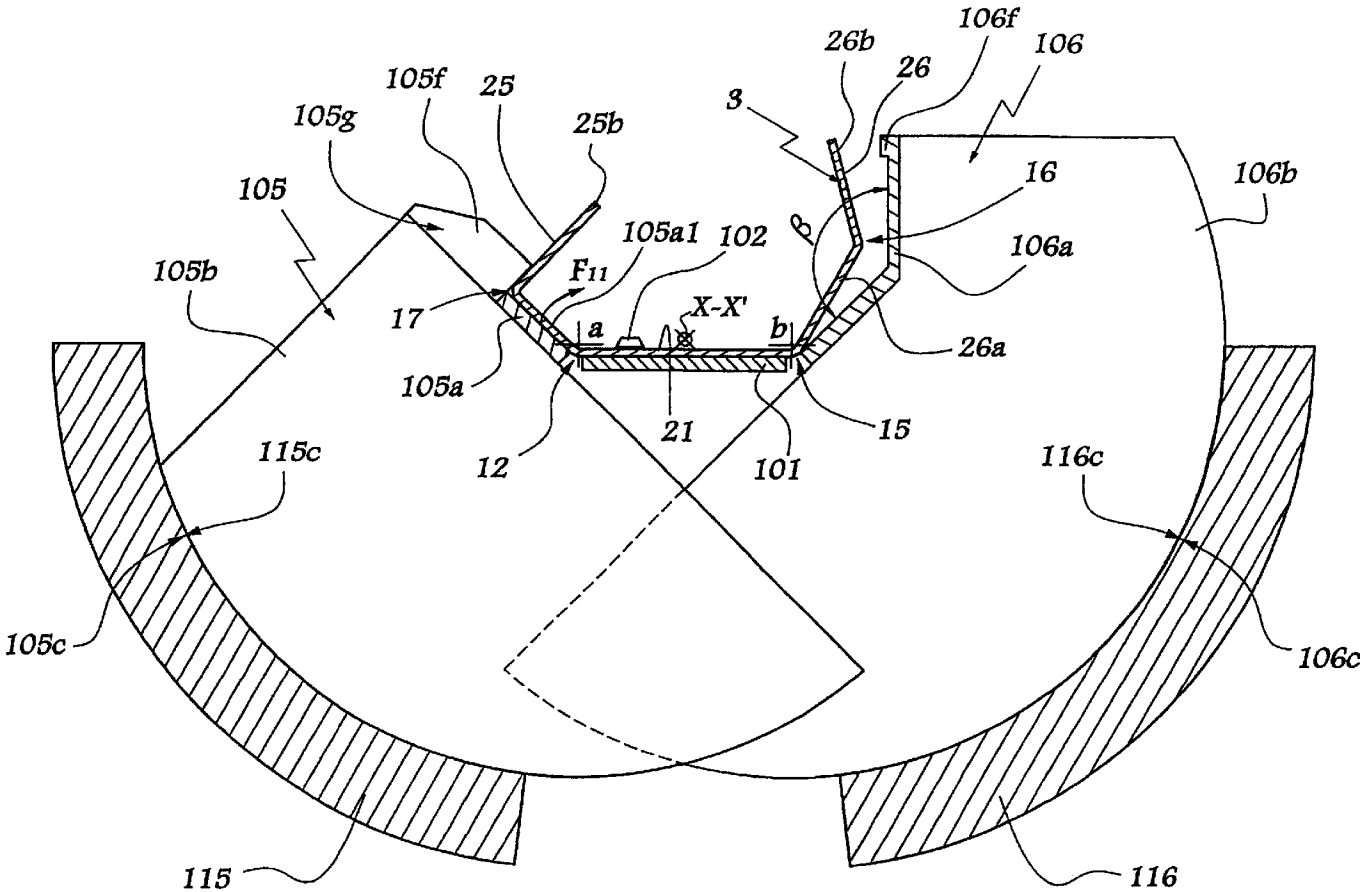
FIG. 8 is a section along line VIII—VIII in FIG. 2, the frame being shown in place in the installation.
Figure 9:
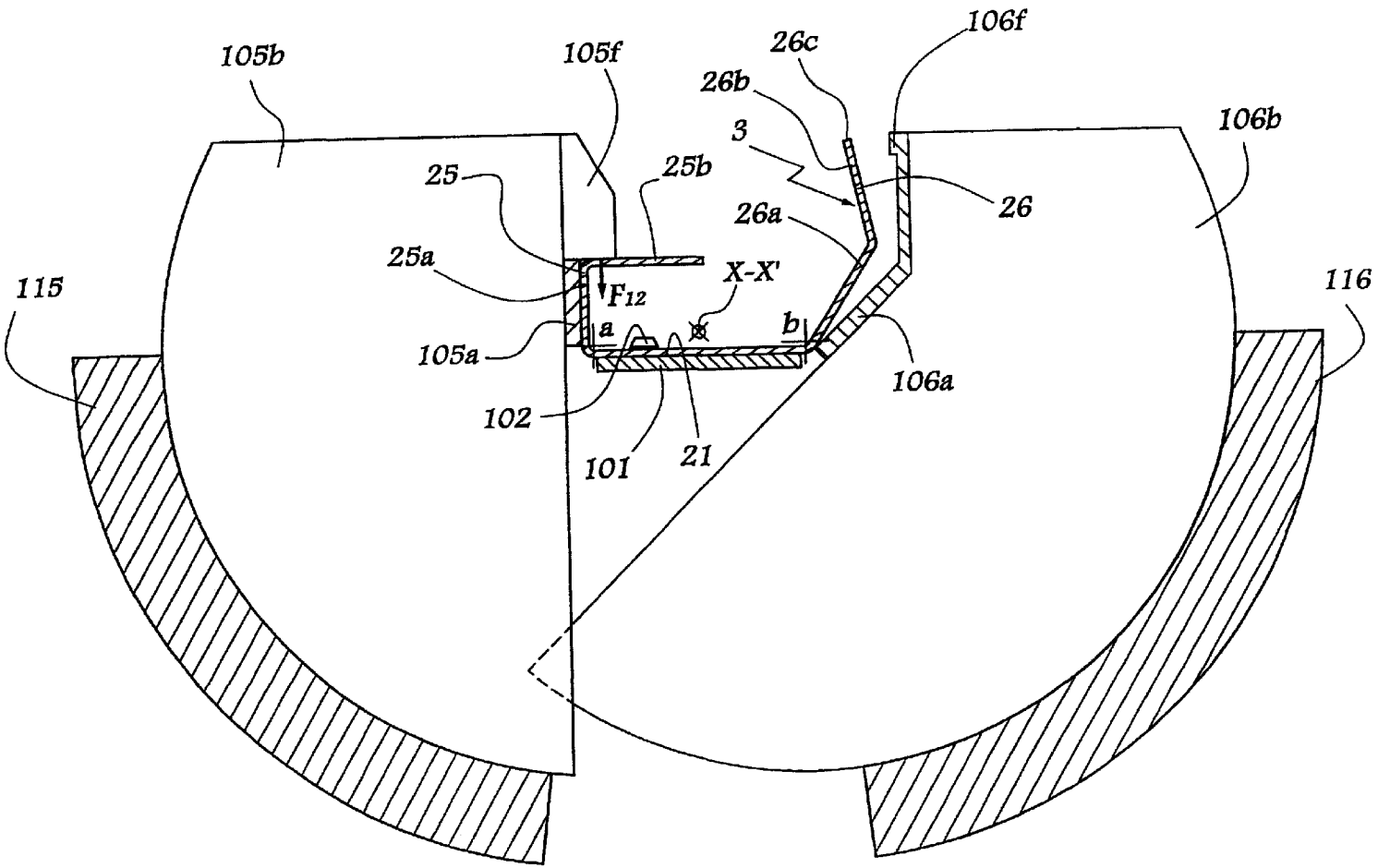
FIG. 9 is a section similar to FIG. 8 during a subsequent step of the method of the invention.
Figure 10:
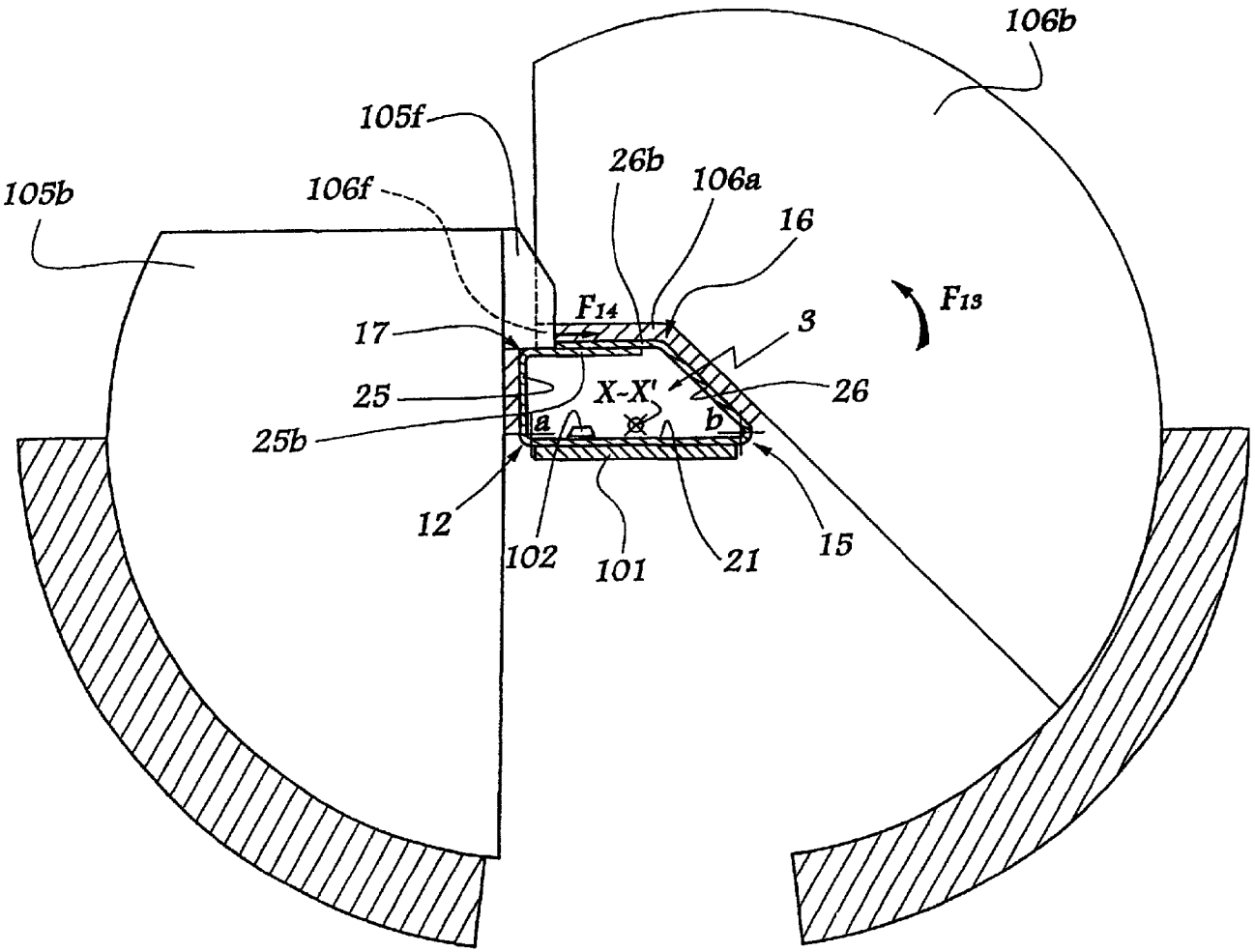
FIG. 10 is a section similar to FIG. 8 during a second subsequent step of the method of the invention.

Referring more particularly to FIGS. 8 to 10, it is noted that the lateral upright 3 is of quadrangular section. A jaw 105 is provided to cooperate with the flange 25 and comprises a base plate 105*a* of which one face 105*a*1 in contact with the flange 25 makes it possible to exert an effort $F_{11}$ to bend the flange 25 down in the direction of elements 21 and 101. Like jaw 103, the jaw 105 is equipped with ribs 105*b* defining cylindrical convex surfaces 105*c* centred on the axis a and making it possible to cooperate with a cradle 115 defining a concave surface 115*c* for slide of the surfaces 105*c*, the surface 115*c* being, like surfaces 105*c*, of circular base and centred on axis a. The jaw 105 is equipped with a plurality of heels 105*f* distributed over its length parallel to axis X–X', these heels being provided to come into contact with the flange 25 at the level of edge 17, constituting a stop for a possible slide of the flange 25. The heels 105*f* exert on the flange 25 a clamping effort $F_{12}$ directed towards the edge 12 and parallel to panel 25*a*. The effort $F_{12}$ has the same function as the efforts $F_7$ and $F_8$ evoked previously. It makes it possible to efficiently position the flange 25 with respect to the axis a all along the operation of bending effected thanks to the effort $F_{11}$.

In the same way, a jaw 106 is provided to cooperate with the flange 26 and comprises a plate 106*a* forming a face 106*a*1 for abutment against the flange 26 and equipped with ribs 106*b* whose convex outer radial surfaces 106*c* cooperate with a concave surface 116*c* of a cradle 116. The surfaces 106*c* and 116*c* are centred on a geometrical axis or virtual axis b constituting the centre of the edge 15 and located, like axis a, in the interior volume of the upright 3.

The jaw 106 is equipped with heels 106*f* making it possible to retain the flange 26 in position with respect to the plate 106*a* in the course of bending of the edge 15. The plate 106*a* is not planar but forms a concave zone for receiving the panels 26*a* and 26*b*, the plate 106*a* itself being formed by two panels oriented one with respect to the other with an angle β corresponding to the angle of orientation of the panels 26*a* and 26*b* with respect to one another. The heels 106*f* are disposed in order to come into abutment against the free edge 26*c* of the panel 26*b*.

The heels 106*f* are distributed over the length of the plate 106*a*.

The heels 105*f* on the one hand and 106*f* on the other hand, are positioned in quincunx with respect to each other, being offset along the axis X–X', a heel 105*f* being opposite a free gap 106*g* defined between two heels 106*f*, while a heel 106*f* is disposed opposite a free gap 105*g* defined between two heels 105*f*.

The bending of the upright 3 may be explained with reference to FIGS. 8 to 10. In the configuration of FIG. 8, an effort is exerted on the jaw 105 by any appropriate means, with the result that it is displaced and exerts the bending effort $F_{11}$ of the flange 25 in the direction of the part 21, the heels 105*f* overlapping the zone of join 25*c*, defined between the panels 25*a* and 25*b* and which includes the edge 17. The effort $F_{11}$ makes it possible to bend the flange 25 down as far as the position of FIG. 9 where the panel 25*a* is substantially perpendicular to the part 21, the panel 25*b* being substantially parallel to this part. In the course of the bending operation made between the configurations of FIGS. 8 and 9, the effort $F_{12}$ efficiently retains the flange 25 in position with respect to the jaw 105 and to the edge 12.

The jaw 106 is in that case activated, in order to pass from the position of FIG. 9 to that of FIG. 10, an effort $F_{13}$ of bending of the flange 26 in the direction of the part 21 being exerted by the plate 106*a* while an effort $F_{14}$ is exerted by the heels 106*f* on the flange 26 parallel to this flange and substantially in the direction of the edge 15.

As previously, the efforts $F_{12}$ and $F_{14}$ may be modulated as a function of the orientation of the jaws 105 and 106 about axes a and b. In a variant, the axes a and b may be offset with respect to their representation in FIGS. 8 to 10 in order to compensate the variations in length of the flanges 25 and 26.

In addition, in the configuration of FIG. 10, the effort $F_{12}$ may be released or reduced by a movement of the heel 105*f* in a sense of moving away with respect to the edge 12, with the result that, due to the elasticity of the plate 10, the panel 25*b* comes into firm elastic abutment against that face of the panel 26*b* oriented towards the part 21. It is in that case possible to spot weld the panels 25*b* and 26*b* thanks to a high energy beam directed between two adjacent heels 105*f* and 106*f*.

In order to attain the elastic abutment of the panels 25*d* and 26*d*, it is also possible to provide for the angle of bend between the panels 25*a* and 25*b* to be slightly more open than that obtained in the configuration of FIG. 10, with the result that an elastic abutment is obtained in this configuration without it being necessary to release the effort $F_{12}$.

As is more clearly visible in FIGS. 11 to 14, the frame 2 is conformed, after shaping of the different uprights 3, 3', 4 and 4', by bending. When the tubular uprights have been made, the plate 10 extends substantially in the direction X–X' in four sections joined by zones of join 8, 8' and 8". A tool 20 is provided for shaping the frame 2 and comprises four flaps 201, 202, 203 and 204 intended each to receive one of the uprights 3, 3', 4 or 4'.

These flaps 201 to 204 are each formed by two massive pieces 201*a*, 201*b*, 202*a*, 202*b*, 203*a*, 203*b*, 204*a*, 204*b* joined by a screw/nut system 201*c*, 202*c*, 203*c* or 204*c* for adjustment of the flaps 201 to 204 in length. Guide rods 201*c'*, 202*c'*, 203*c'* and 204*c'* are associated with the systems 201*c* to 204*c*. The length of each flap 201 to 204 is adjusted, parallel to its largest dimension $X_1$ to $X_4$, to the length of the upright that it must receive. The flaps 201 to 204 are provided to be adjustable in length in order to allow frames 2 of different sizes to be manufactured.

The pieces 201*a* and 201*b* are respectively provided with angles 201*d*, 201*e* for receiving the upright 4. Jaws 201*f*, 201*g* are provided to immobilize the upright 4 against the angles 201*d* and 201*e*. In the same way, the flaps 202, 203 and 204 are respectively equipped with angles 202*d* to 204*e* and with jaws 202*f* to 204*g*. As is more particularly visible in FIGS. 11 and 12, the jaws are shaped as a function of the geometry of the flanges 24 and 26.

The flaps 201 and 202 are articulated together about an axis $Y_1$ essentially perpendicular to the principal direction X–X' of the uprights 3, 4, 3' and 4'. The axis $Y_1$ is also perpendicular to the direction $X_1$ along which the flap 201 is adjustable in length. In the same way, the flaps 202 and 203 are articulated together about an axis $Y_2$ while the flaps 203 and 204 are articulated together about an axis $Y_3$, these axes $Y_2$ and $Y_3$ being substantially perpendicular to axis X–X' and to the directions $X_1$, $X_2$, $X_3$ and $X_4$ for adjusting the different flaps in length.

Figures 12, 13:
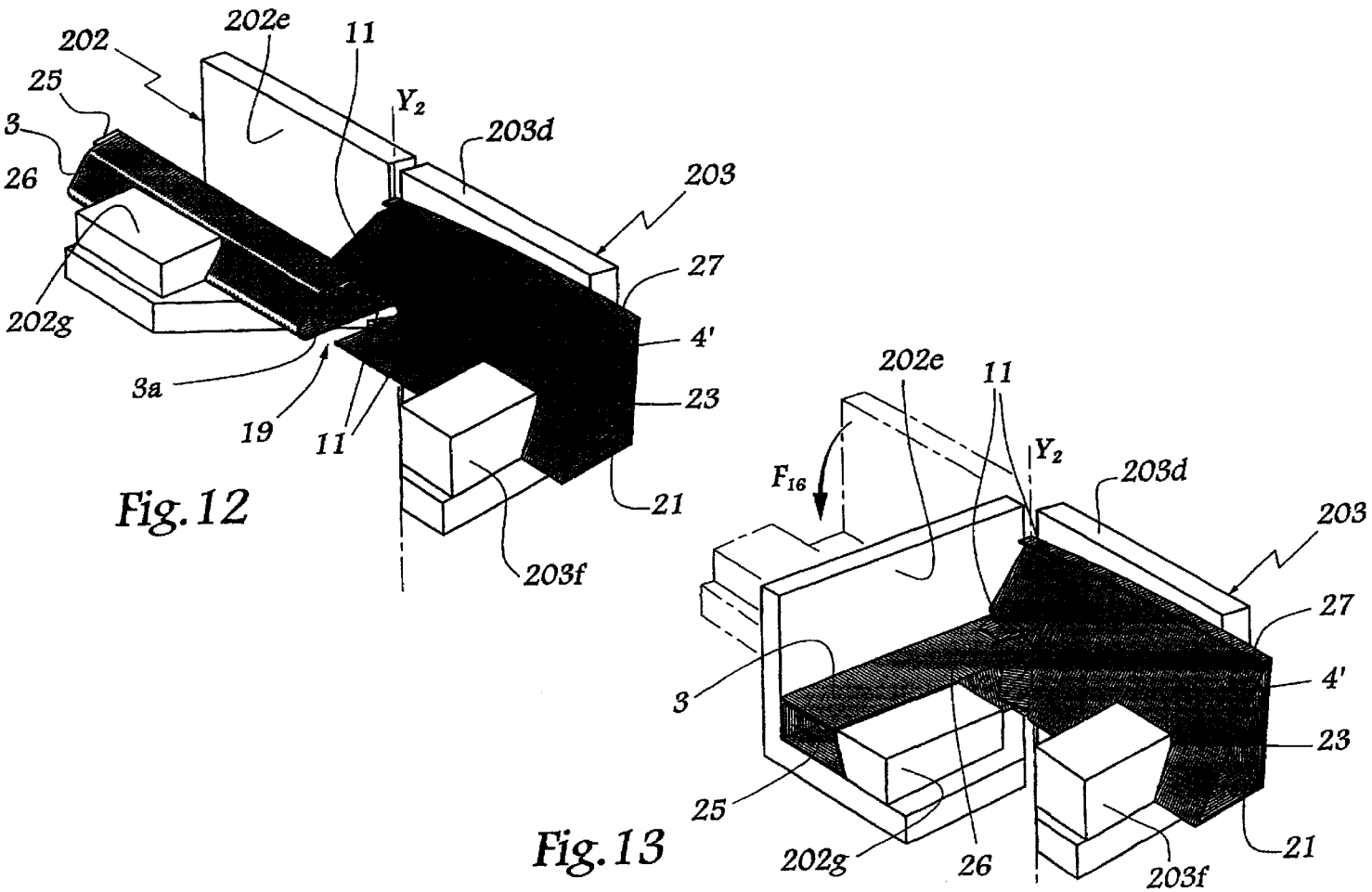
FIG. 12 is a view on a larger scale of detail XII in FIG. 11, the frame being in place on the tool.
FIG. 13 is a view similar to FIG. 12 during a subsequent step of manufacture of the frame.
Figure 14:
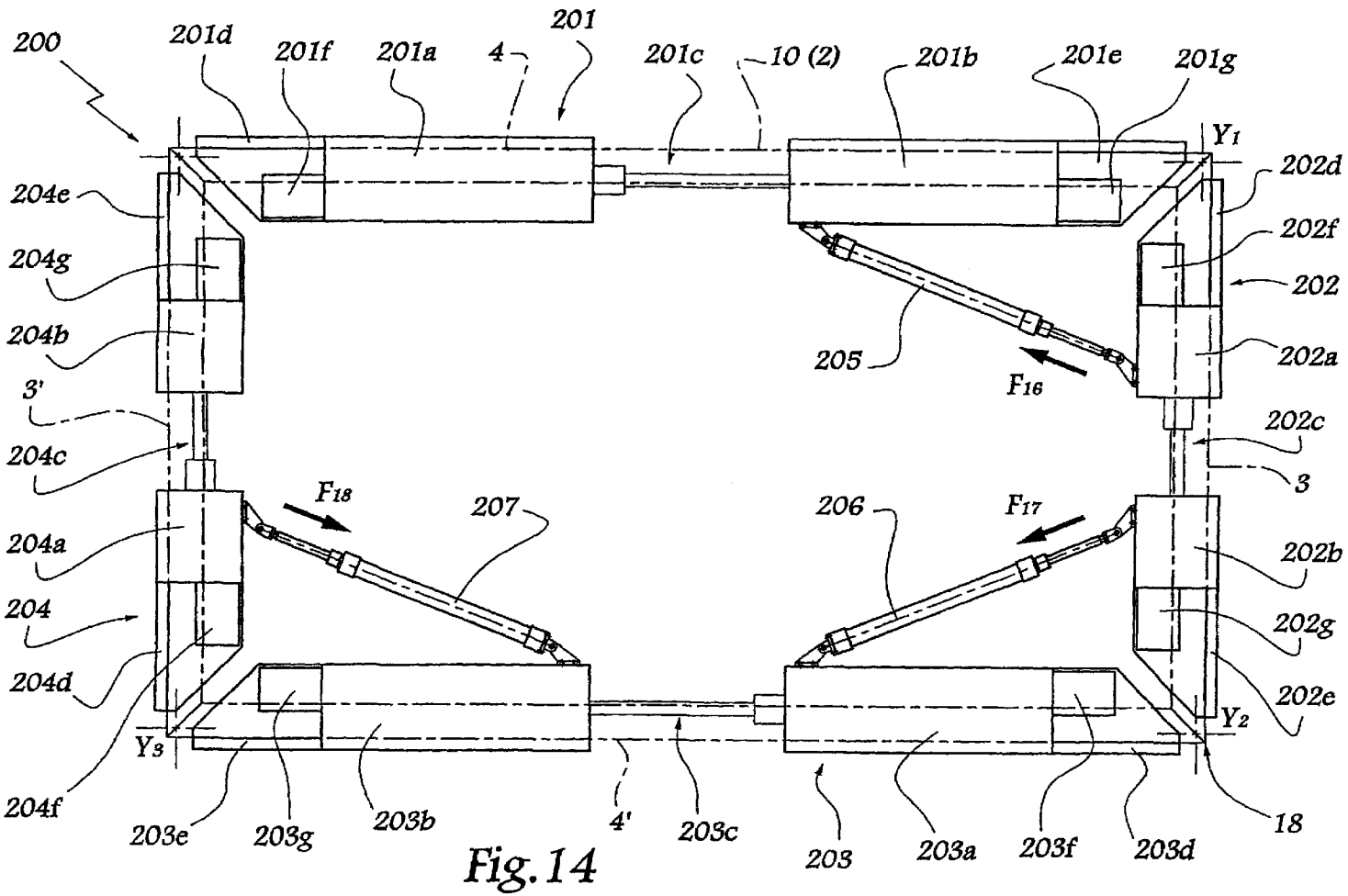
FIG. 14 is a plan view of the part of the installation shown in FIGS. 11 to 13, in the course of use.

Three jacks 205, 206 and 207 respectively join the flaps 201 and 202, the flaps 202 and 203 and the flaps 203 and 204, with the result that they are adapted to exert thereon efforts or forces of closure represented by arrows $F_{16}$, $F_{17}$ and $F_{18}$ in FIG. 14. These efforts make it possible to take the tool 200 into a substantially rectangular configuration in a plane perpendicular to axes $Y_1$ to $Y_3$, which makes it possible to bend the frame 2 at zones 8, 8' and 8" and to form corners such as corner 7, as represented in FIGS. 12 and 13. In effect, the effort or force $F_{17}$ has the effect of bringing together the sides of the flaps 202 and 203 joined by the jack 206, which results in a bending of the plate 10 along a line 18 parallel to axis $Y_2$. The tongues 11 arranged on the upright 4 are thus made to overlap the edge 3*a* of the upright 3, these tongues and this edge in that case being able to be welded by a high energy beam.

In the configuration of FIG. 14, the tool 200 forms a rectangle whose flaps 201 to 204 constitute the four sides. This rectangle is closed at the level of a zone of join between the flaps 201 and 204 where there are provided locking means (not shown) associated with guiding means, likewise not shown. In this way, the rectangle shown in FIG. 14 is defined precisely by the cooperation of the flaps 201 to 204, with the result that the geometry of the frame 2 thus obtained is also defined precisely.

Figure 11:
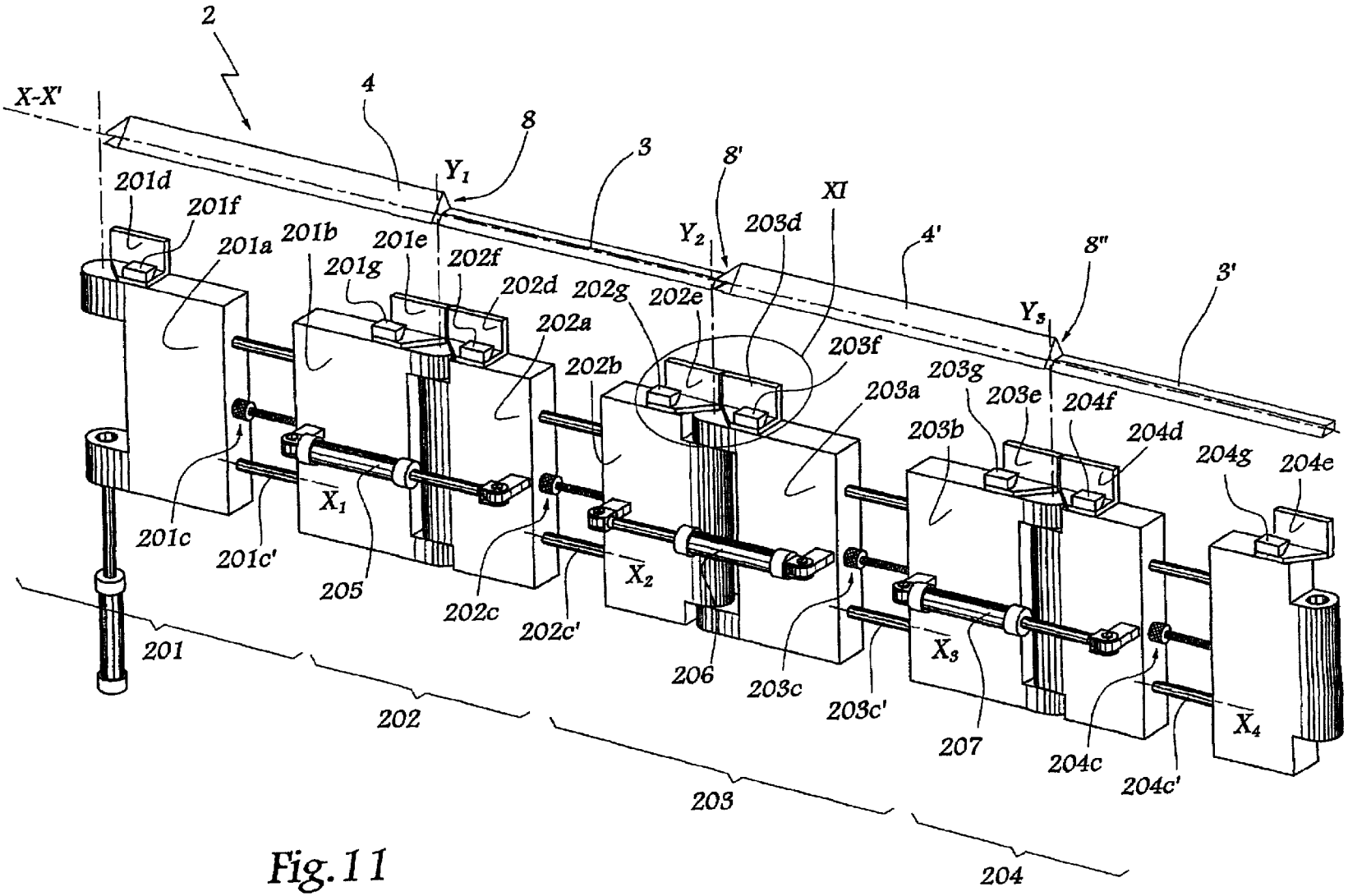
FIG. 11 is a view in perspective of another part of the installation of the invention, a frame in the course of manufacture being shown above this part of the installation.
Figure 16:
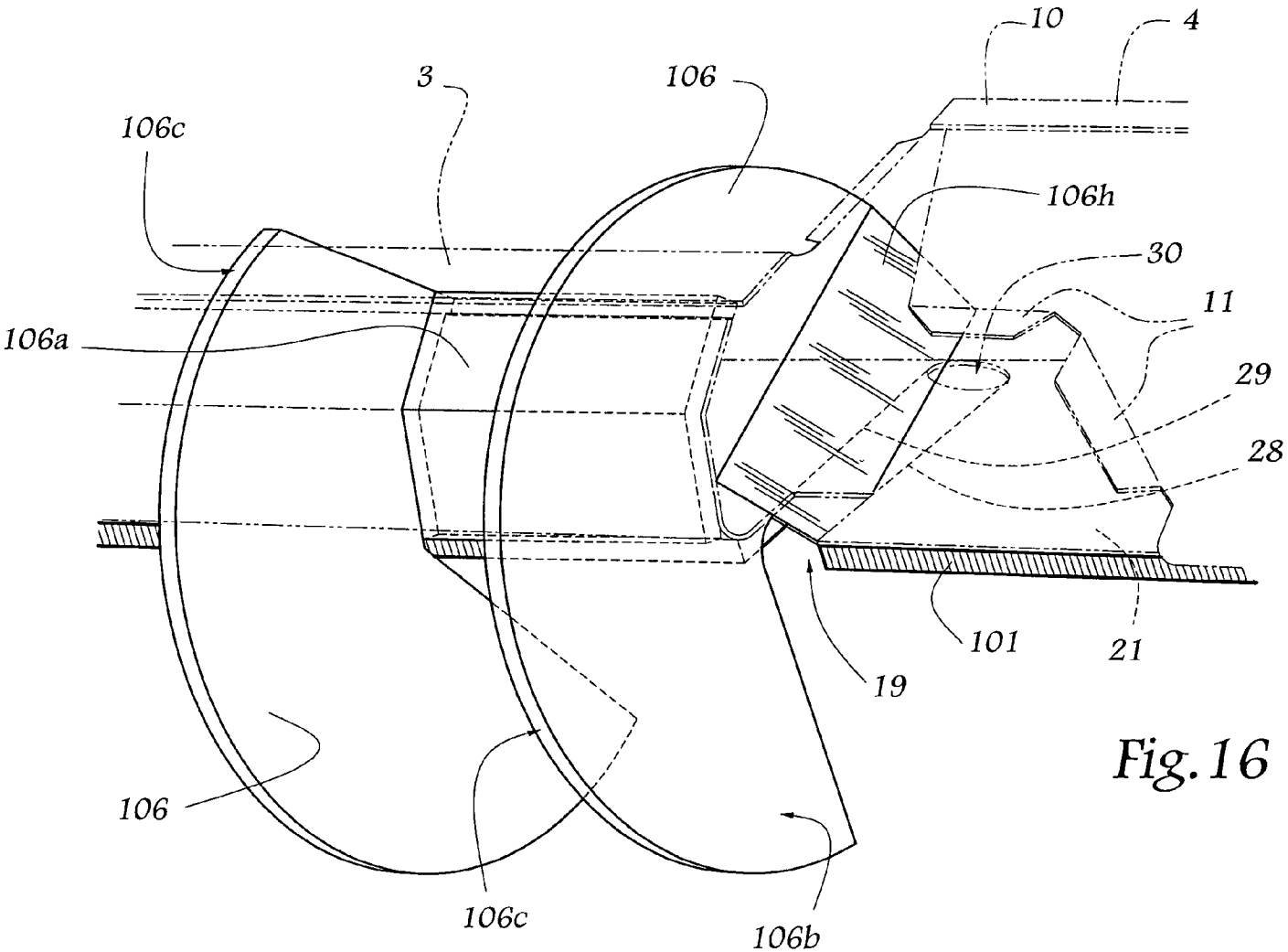
FIG. 16 schematically shows a perspective view of a part of the installation.

According to an advantageous aspect of the invention shown solely in FIG. 16, the jaw 106 is equipped with a blade 106*h* forming shears with the plate 101 and making it possible to cut out, during the bending of the upright 3, the plate 10 in the zone of join of the uprights 3 and 4 so as to create a notch 19 visible in FIG. 11 compatible with the movement of bend about axis $Y_2$. Due to the use of the blade 106*h*, the notch is created after the operations of shaping the tubular uprights 3, 3', 4 and 4'. Before the use of this blade, the plate 10 presents a continuity in the zones 8, 8' and 8" of join between the uprights 3 and 4. In other words, the incorporation of the blade 106*h* on the jaw 106 enables the notch 19 to be made just before the use of the tool 200, which avoids too great stresses at the level of the line 18 during production of the tubular parts. In practice, the blade 106*h* may be with double cutting edge, with the result that it makes it possible to cut out the plate 10 along two parallel lines 28 and 29 defining therebetween the notch 19 up to a bore 30 previously made in the plate 10. Of course, the jaws 103, 104 and 105 may also be equipped with blades forming shears.

As a function of the geometry of the frame 2, i.e. as a function, in particular, of the length of the uprights and of their cross-section, different sets of jaws 103 to 106 and of cradles 113 to 116 may be used, the jaws and the cradles being placed in position jointly in the installation 100, which makes it possible to effect a rapid standard exchange of the assembly of the bending members of this installation.

The use of the jaws 103 to 106 that may slide on cradles 113 to 116 of different geometrical axes, such as axes a and c, makes it possible to produce non-aligned edges, such as the edges 13 and 15, which would not be possible with conformation jaws articulated on common hinges.

In the Figures, the jaws 103 and 105 and the cradles 113 and 115 have been shown as two distinct units. However, it might be question of the same unit forming bending member at the same time for uprights 3 and 4, as the axis of bend a is the same for the whole edge 12 over the length of the plate 10. This is why the plates 103*a* and 105*a*, on the one hand, and the cradles 103*d* and 105*d*, might be constituted in one piece.

When the plate to be bent is thin and in order to avoid a phenomenon of buckling of its flanges under the effect of the clamping efforts, it may be provided to apply the metal sheet against the plates 103*a* to 106*a* of the jaws 103 to 106 by suction or by magnetic attraction. To that end, the jaws 103 to 106 may be provided with channels opening out on the faces 103*a*1, 103*a*2, 105*a*1 and 106*a*1 and connected to a source of vacuum. The jaws may also be equipped with permanent magnets or with electro-magnets allowing an immobilization of the flanges 23 to 26.

Figure 17:
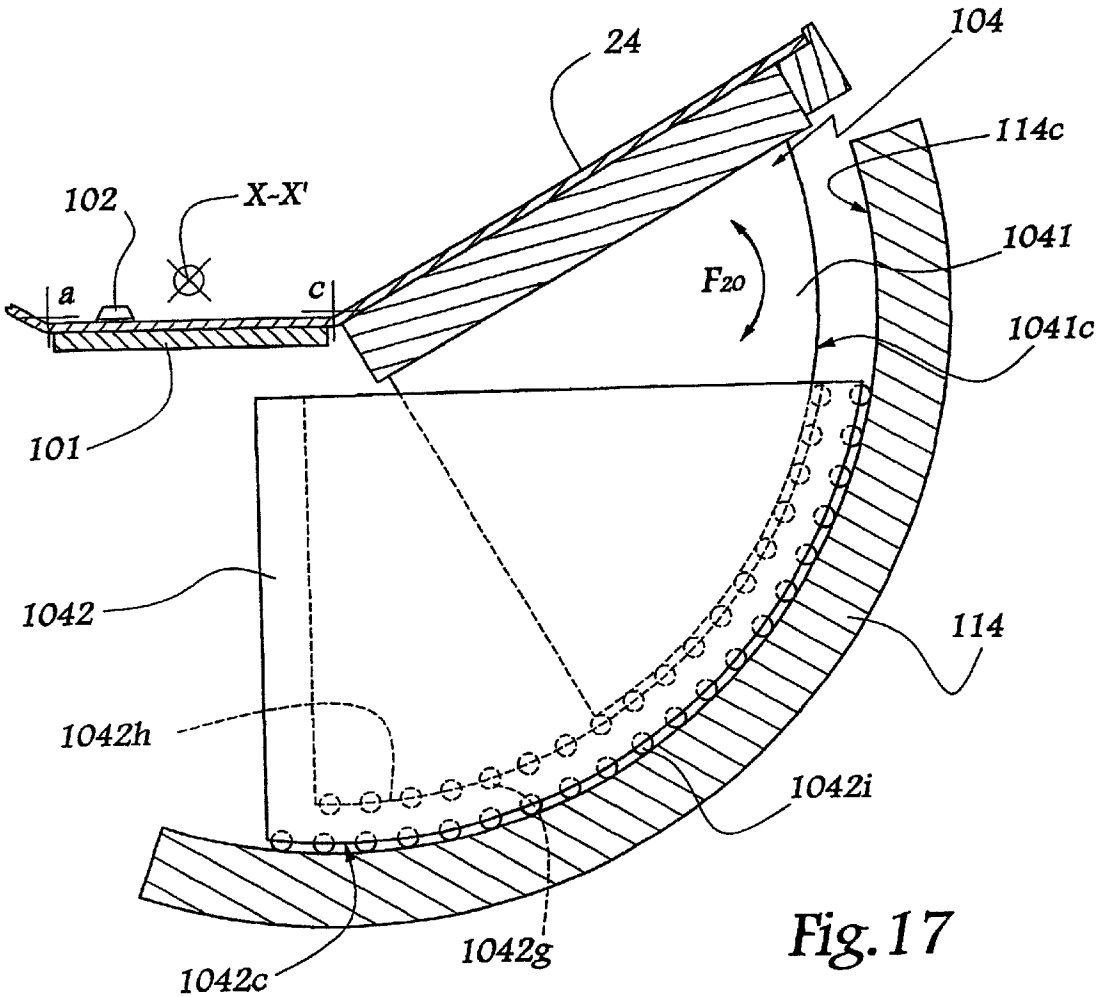
FIG. 17 is a schematic section of a part of an installation in accordance with a second form of embodiment of the invention.

As shown in FIG. 17 for an installation according to a second form of embodiment of the invention, the jaws, such as jaws 104 may be guided by cradles, such as cradle 114 thanks to telescopic circular segments 1041 and 1042 which make it possible, for a given geometry of a cradle 114, to obtain an efficient guiding for a movement $F_{20}$ of pivoting of the jaw 104 about axis c of high amplitude. The segment 1041 is fast with the jaw 104 while it is fitted inside the segment 1042, this segment 1042 itself being mobile in abutment against the inner cylindrical surface 114*c* of the cradle 114.

The segment 1042 is hollow while segment 1041 is solid and of width less than the width of the inner volume of the segment 1042.

The segment 1042 is provided with rollers 1042*g* disposed along its inner surface 1042*h* and adapted to cooperate with the edge 1041*c* of the segment 1041. These rollers facilitate the relative slide between the segments 1041 and 1042. Moreover, the edge 1042*c* of the segment 1042 is also provided with rollers 1042*i* adapted to cooperate with the inner surface 114*c* of the cradle 114. This facilitates pivoting of the segment 1042.

According to variants of the invention (not shown), the segment 1041 and/or the cradle 114 may be equipped with balls or rollers for slide.

The invention has been described, with reference to the first form of embodiment, with jaws equipped with ribs of which the end surfaces 103*c*, 104*c*, 105*c* and 106*c* are provided to slide against the cylindrical surfaces 113*c* to 116*c* of the cradles 113 to 116. However, the ribs 103*b* to 106*b* may be equipped with runners incorporating balls or rollers, such balls or rollers being provided to roll on the surfaces 113*c* to 116*c*.

Other modes of guiding the jaws by the cradles may be envisaged.

Figures 18, 19:
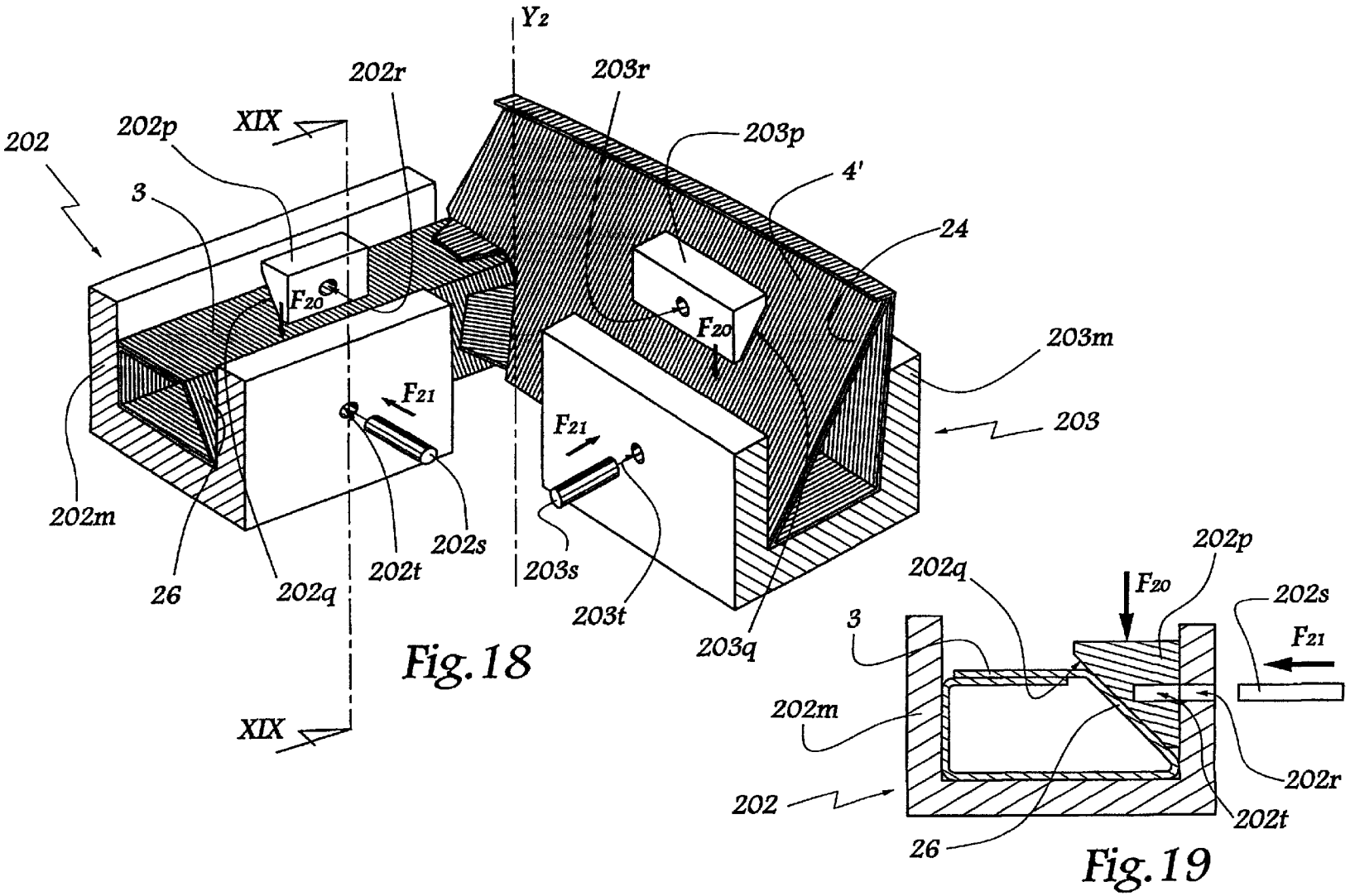
FIG. 18 is a view similar to FIG. 13 for the installation of FIG. 17.
FIG. 19 is a section along line XIX—XIX in FIG. 18.

As is more particularly visible in FIGS. 18 and 19, the angles 201*d* to 204*e* and the jaws 201*f* to 204*g* of the first form of embodiment may be replaced by profiles of cross-section substantially in U-form, of which two are shown in FIG. 18, with references 202*m* and 203*m*. These profiles have a cross-section suitable for receiving the uprights 3 and 4'respectively, being fixed on flaps similar to flaps 202 and 203 of the first embodiment.

Shims 202*p* and 203*p* are respectively associated with the sections 202*m* and 203*m* for wedging the uprights 3 and 4' in position. These shims have a substantially triangular section with a truncated angle, i.e. in fact a trapezoidal section. When the uprights 3 and 4' have been placed in position in the profiles 202*m* and 203*m*, the shims are introduced in the profiles as represented by arrows $F_{20}$, the geometry of the shims 202*p* and 203*p* being such that they are each provided with a surface 202*g*, 203*g* adapted to rest against certain flanges 24 or 26 of the profiles 3 and 4'.

Each shim 202*p* or 203*p* is provided with a blind hole 202*r*, 203*r* for receiving a pin 202*s*, 203*s* provided to pass through an orifice 202*t*, 203*t* of the profiles 202*m* and 203*m*. The introduction of the pin 202*s* in the orifice 202*t* and the blind hole 202*r* is represented by arrows $F_{21}$. Once the pins 202*s* and 203*s* are in place in the holes and orifices 202*r*, 202*t*, 203*r* and 203*t*, the shims are immobilized on the profiles 202*m* and 203*m* and maintain the uprights 3 and 4' in place.

The invention has been shown with jaws whose inner surfaces 103*a*1 to 106*a*1 are planar while the flanges 23 to 26 are also planar. Of course, these surfaces and these flanges may be skew as a function of the geometry desired for the uprights 3, 3', 4 and 4'.

The invention has been shown when employed for manufacturing shadow mask support frames. Such frames may be made in one, two or four parts, each part forming one, two or the four uprights of the frame.

What is claimed is:

1. Method for making a workpiece (2) comprising at least one tubular section (3, 3', 4, 4') obtained by bending a metal plate (10) along at least one longitudinal line of bending (12–17) intermediate opposite edge portions of the metal plate, the method including the steps of:

initially pre-bending (F) said plate (10) along at least two lines of bending (12–17) to thereby define at least two parts (23–26) that are bendable relatively toward one another about the at least two longitudinal lines of bending; and thereafter applying a bending force ($F_1$, $F_3$, $F_{11}$, $F_{13}$) to at least one of the at least two parts to urge the at least one part toward another part of the at least two parts such that the at least two parts at least begin to define a tubular section having inner and outer surfaces and wherein the bending force is applied only along the outer surface and without any forming member within the tubular section being formed while simultaneously applying a clamping force ($F_7$, $F_8$, $F_{12}$, $F_{14}$) with respect to the at least one part to urge the at least one part toward one of the at least two lines of bending buy a bending member (103–106) that engages the at least one part along an outer surface thereof and such that the clamping force prevents slipping of the at least one part relative to the bending member as the bending member bends the at least one part.

2. Method according to claim 1, wherein the pre-bending is effected by immobilizing the plate on an apron (101) by means of a retractable holding clamp (107).

3. Method according to claim 1 including an additional step of preparing the sheet for pre-bending by weakening the metal sheet along the at least two lines of bending (12–17).

4. Method according to claim 1 wherein the plate has at least two longitudinally disposed sections each having differently positioned lines of bending, and bending the plate (10) along different lines of bending (12–17) along a length thereof, with the result that tubular sections (3, 3', 4, 4') of different cross sectional profiles are formed.

5. Method according to claim 1 including bending the plate (10) about at least one virtual geometrical axis (a, b, c) defined by a cooperation of the bending member (103–106) and of guide means (113–116) associated therewith.

6. Method according to claim 1 wherein the clamping force ($F_7$, $F_8$, $F_{12}$, $F_{14}$) is directed substantially towards an adjacent line of bending (12, 13, 15).

7. Method according to claim 6 clamping force ($F_7$, $F_8$, $F_{12}$, $F_{14}$) is directed substantially perpendicular to the adjacent line of bending (12–17).

8. Method according to claim 1 wherein the clamping force ($F_7$, $F_8$, $F_{12}$, $F_{14}$) stresses the one of the at least two parts (23, 24, 25*a*, 26*b*) of said plate (10) parallel to itself and perpendicularly to the bending force ($F_1$, $F_3$, $F_{11}$, $F_{13}$) exerted on the one of the at least two parts by the bending member (103–106).

9. Method according to claim 1 wherein the clamping force ($F_7$, $F_8$, $F_{12}$, $F_{14}$) is adapted as a function of a position of the bending member (103–106).

10. Method according to claim 1 including bending a first part (26) of the plate (10) to overlap a second part (25) of the plate and reducing the clamping force ($F_{12}$) exerted on the second part so that the first and second parts are in elastic abutment against each other, and thereafter welding the first and second parts together.

11. Method according to claim 1 wherein the plate (10) is bent about at least one virtual axis (a, b, c) defined as a geometrical axis of a cylindrical cradle (113–116) that is used for guiding said bending member (103–106).

12. Method according to claim 1 wherein the plate (10) is bent about different bending axes (a, b, c) along a length (X–X') of the workpiece (2) using a plurality of bending members (103–106) guided by cradles (113–116) of different geometrical axes (a, b, c) corresponding to the bending axes.

13. Method according to claim 4 wherein, after formation of a plurality of tubular sections (3, 3', 4, 4'), thereafter shaping the plurality of tubular sections as a closed frame (2) by bending joining sections (8, 8', 8") between two adjacent tubular sections, perpendicularly to a length (X–X') of said tubular sections.

14. Method according to claim 1 including a step of retaining, by suction or magnetic attraction, the at least one of the two parts (23–26) of the plate against a part (103*a*–106*a*) of the bending member (103–106).

15. Installation for manufacturing a workpiece (2) comprising at least one tubular section (3, 3', 4, 4'), the installation comprising at least one bending member (103–106) for bending a metal plate (10) along a longitudinal line of bending (12–17) of the tubular section without an internal forming structure, said bending member being equipped with clamping means (103*f*–106*f*) for exerting on a part (23–26) of said plate a clamping force ($F_7$, $F_8$, $F_{12}$, $F_{14}$) that prevents sliding of the part (23–26) of plate (10) along said bending member (103–106), while said bending member is articulated about a virtual axis (a, b, c) of bend located inside the at least one tubular section (3, 3', 4, 4').

16. Installation according to claim 15, including a plurality of bending members (103–106) adapted to bend said plate (10) along distinct lines of bending (12–17), with the result that tubular sections (3, 3', 4, 4') of different profiles are formed.

17. Installation according to claim 16, wherein each of said clamping means is constituted by at least one heel (103*f*–106*f*) forming a stop for abutment of the plate (10).

18. Installation according to claim 17, wherein said at least one heel (103*f*–106*f*) extends over substantially an entire length (X–X') of one of the lines of bending.

19. Installation according to claim 16, characterized in that said clamping means comprise a plurality of heels (105*f*106*f*) distributed over an entire length (X–X') of the lines of bending (12, 15) and separated by spaces (105*g*–106*g*) for receiving heels used with the bending members bending the plate (10) along another line of bending.

20. Installation according to claim 15, including means for varying a position ($F_9$)of said clamping means with respect to the line of bending.

21. Installation according to claim 15, including means for adjusting the clamping force ($F_7$, $F_8$, $F_{12}$, $F_{14}$) exerted by said clamping means (103*f*–106*f*) on the plate (10).

22. Installation according to claim 15, wherein said bending member (103–106) includes at least one surface (104*a*1–106*a*1) for abutment against said plate (10) and at least one circular-base cylindrical surface (103*c*–106*c*) adapted to cooperate with a circular-base cylindrical surface (113*c*–116*c*) of a cradle (113–116), said cylindrical surfaces being centered on the virtual axis (a, b, c) of bend of the plate.

23. Installation according to claim 22, including a plurality of bending members (103–106) distributed over a length (X–X') of the plate (10) and each bending member including a cradle (113–116) whose cylindrical surface (113*c*–116*c*) has virtual axes (a, b, c) parallel and offset with respect to one another.

24. Installation according to claim 22, wherein said cylindrical surfaces are substantially of the same radius ($R_{103}$, $R_{113}$, $R_{104}$, $R_{114}$).

25. Installation according to claim 22 wherein each bending member (104) is guided with respect to said surface (114*c*) of said cradle (114) by telescopic segments (1041, 1042).

26. Installation according to claim 25, wherein said cylindrical surfaces (103*c*—106*c*), said telescopic segments (1041, 1042) and/or said surface (113*c*–116*c*) of said cradles (113–116) are equipped with balls or rollers (1042*g*–1042*i*).

27. Installation according to claim 16 including a tool (200) for forming the workpiece (2), said tool including elements (201–204) supporting tubular sections (3, 3', 4, 4') of said workpiece (2) provided with means (201*d*–204*d*, 201*e*–204*e*, 201*f*–204*f*, 201*g*–204*g*) for receiving and immobilizing the tubular parts, and said means for receiving and immobilizing being articulated ($Y_1$, $Y_2$, $Y_3$) with respect to one another.

28. Installation according to claim 27, wherein said means for receiving and immobilizing (201–204) are adjustable in length ($X_1$, $X_2$, $X_3$, $X_4$).

29. Installation according to claim 27 wherein said means for receiving and immobilizing (201–204) are adapted to form, together, a closed figure of predetermined geometry corresponding to the geometry of a workpiece (2) in a configuration of a frame.

30. Installation according to claim 27 wherein at least one of said means for receiving and immobilizing (203–204) is equipped with a member (202*m* or 203*m*) with cross-section substantially in a form of a U adapted to receive at least one shim (202*p*, 203*p*) for blocking one of said tubular sections (3, 3', 4, 4') in place therein, and means (202*s*–203*s*) to immobilize said at least one shim.

31. Installation according to claim 15, wherein at least one (106) of said bending members (105–106) is equipped with a blade (106*h*) forming shears for cutting out the plate (10) during its bending ($F_{13}$).

32. Use of a method according to claim 1, for manufacturing a frame (2) for supporting a shadow mask (1) for a cathode-ray tube.

33. Use of an installation according to claim 15, for manufacturing a frame (2) for supporting a shadow mask (1) for a cathode-ray tube.

* * * * *